US010948227B2

(12) United States Patent
Jeong et al.

(10) Patent No.: US 10,948,227 B2
(45) Date of Patent: Mar. 16, 2021

(54) REFRIGERATOR AND CONTROL METHOD THEREOF

(71) Applicant: Samsung Electronics Co., Ltd., Suwon-si (KR)

(72) Inventors: Jin Jeong, Yongin-si (KR); Kook Jeong Seo, Seoul (KR); Bong Su Son, Cheonan-si (KR); Do Yun Jang, Suwon-si (KR); Yeon Woo Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 61 days.

(21) Appl. No.: 15/947,407

(22) Filed: Apr. 6, 2018

(65) Prior Publication Data

US 2018/0335240 A1 Nov. 22, 2018

(30) Foreign Application Priority Data

May 17, 2017 (KR) ..... 10-2017-0060874

(51) Int. Cl.

| | |
|---|---|
| ***F25C 5/20*** | (2018.01) |
| ***F25C 5/187*** | (2018.01) |
| *F25C 5/185* | (2018.01) |
| *F25C 1/24* | (2018.01) |

(52) U.S. Cl.

CPC ..... *F25C 5/22* (2018.01); *F25C 5/187* (2013.01); *F25C 5/24* (2018.01); *F25C 1/24* (2013.01); *F25C 5/185* (2013.01); *F25C 2500/08* (2013.01); *F25C 2600/04* (2013.01); *F25C 2700/10* (2013.01); *F25D 2400/36* (2013.01)

(58) Field of Classification Search

CPC .... F25C 2500/08; F25C 2700/06; F25C 5/22; F25C 5/185; F25C 2600/04; F25D 29/006; F25D 29/008

See application file for complete search history.

(56) References Cited

U.S. PATENT DOCUMENTS

| | | | | |
|---|---|---|---|---|
| 3,537,618 A * | 11/1970 | Alvarez | C07D 213/79 222/333 |
| 4,252,002 A * | 2/1981 | Mullins, Jr. | F25C 5/24 62/344 |
| 8,365,548 B2 * | 2/2013 | Han | F25C 5/22 62/344 |
| 2007/0204643 A1 * | 9/2007 | Harris | F25C 5/22 62/340 |

(Continued)

FOREIGN PATENT DOCUMENTS

| | | |
|---|---|---|
| KR | 10-2011-0006871 A | 1/2011 |
| KR | 10-2012-0105234 A | 9/2012 |
| KR | 10-2013-0041700 A | 4/2013 |

*Primary Examiner* — Nelson J Nieves

(57) ABSTRACT

Disclosed herein are a refrigerator includes an ice storage, a transfer member, a transfer motor coupled to the transfer member, and a controller configured to control the transfer motor to rotate the transfer member in a first rotation direction and a second rotation direction, wherein the transfer member prevents the ice cubes stored in the ice storage from agglomerating by rotating in the first rotation direction and the second rotation direction. The controller warns a user of agglomeration of the ice cubes stored in the ice storage in response to no rotation of the transfer motor sensed.

18 Claims, 21 Drawing Sheets

(56) References Cited

U.S. PATENT DOCUMENTS

| | | | | |
|---|---|---|---|---|
| 2009/0314016 | A1* | 12/2009 | Ashrafzadeh | F25C 5/187 62/137 |
| 2010/0122547 | A1* | 5/2010 | Han | F25C 5/22 62/340 |
| 2010/0131105 | A1* | 5/2010 | Han | F25C 5/22 700/275 |
| 2011/0067429 | A1 | 3/2011 | Lee et al. | |
| 2013/0334261 | A1* | 12/2013 | Berger | F25C 5/22 222/504 |
| 2017/0191722 | A1* | 7/2017 | Bertolini | F25C 5/08 |
| 2018/0196401 | A1* | 7/2018 | Lagares-Greenblatt | A23L 3/003 |

* cited by examiner

REFRIGERATOR AND CONTROL METHOD THEREOF

CROSS-REFERENCE TO RELATED APPLICATION AND CLAIM OF PRIORITY

This application is based on and claims priority under 35 U.S.C. § 119 to Korean Patent Application No. 10-2017-0060874, filed on May 17, 2017, in the Korean Intellectual Property Office, the disclosure of which is incorporated by reference herein in its entirety.

TECHNICAL FIELD

The present disclosure relates to a refrigerator, and more particularly, to a refrigerator having an ice making apparatus for making ice cubes, and a method of controlling the refrigerator.

BACKGROUND

In general, a refrigerator includes a storage room, and a cool air supply apparatus for supplying cool air to the storage room to keep food fresh. The refrigerator further includes an ice making apparatus for making ice cubes.

An automatic ice making apparatus includes an ice maker for making ice cubes, and an ice storage for storing ice cubes made by the ice maker.

In a direct cooling method among ice making methods for freezing water, a refrigerant pipe extends to the inside of an ice making room to freeze water, wherein the refrigerant pipe directly contacts with an ice making tray. In the direct cooling method, the ice making tray receives cooling energy from the refrigerant pipe by heat conduction.

Ice cubes made by the ice maker are transferred to an ice storage room of the ice storage, and stored in the ice storage room. When the ice cubes are stored in the ice storage room, the ice cubes may agglomerate due to sublimation generated on the surfaces of the ice cubes. In other words, the ice cubes stored in the ice storage room may agglomerate together.

If the ice cubes stored in the ice storage room agglomerate together, the ice cubes will not be easily discharged, which causes a user's inconvenience.

SUMMARY

Therefore, it is an aspect of the present disclosure to provide a refrigerator capable of preventing ice agglomeration.

It is another aspect of the present disclosure to provide a refrigerator capable of warning a user of ice agglomeration.

Additional aspects of the disclosure will be set forth in part in the description which follows and, in part, will be obvious from the description, or may be learned by practice of the disclosure.

In accordance with an aspect of the present disclosure, a refrigerator includes an ice storage, a transfer member, a transfer motor coupled to the transfer member, and a controller configured to control the transfer motor to rotate the transfer member in a first rotation direction and a second rotation direction, where the transfer member prevents the ice cubes stored in the ice storage from agglomerating by rotating in the first rotation direction and the second rotation direction. The controller may warn a user of agglomeration of the ice cubes stored in the ice storage in response to no rotation of the transfer motor sensed.

The controller may rotate the transfer motor in the first rotation direction, where the transfer member transfers the ice cubes in the opposite direction from an outlet of the ice storage by rotating in the first rotation direction, and then the controller may rotate the transfer motor in the second rotation direction, where the transfer member transfers the ice cubes toward the outlet by rotating in the second rotation direction.

The controller may rotate the transfer motor in the first rotation direction for a first transfer time period, and then rotate the transfer motor in the second rotation direction for a second transfer time period. The first transfer time period is longer than or equal to the second transfer time period.

The controller may display, on a display, an image message for requesting removal of the ice cubes stored in the ice storage in response to no rotation of the transfer motor sensed.

The controller may output, through a speaker, a sound message for requesting removal of the ice cubes stored in the ice storage in response to no rotation of the transfer motor sensed.

The controller may output, through a speaker, the sound message for requesting removal of the ice cubes stored in the ice storage in response to opening a door of the refrigerator.

When a time period elapsed after the transfer motor stops is longer than a first reference time period, the controller may control the transfer motor to rotate the transfer member in the first rotation direction and the second rotation direction.

When an operation time period of a cooling apparatus for supplying cool air to the ice storage is longer than a third reference time period, the controller may control the transfer motor to rotate the transfer member in the first rotation direction and the second rotation direction.

When the number of times a door of the refrigerator opens is greater than a first reference number of times, the controller may control the transfer motor to rotate the transfer member in the first rotation direction and the second rotation direction.

When the number of times a refrigerant pipe included in the ice maker is defrosted is greater than a second reference number of times, the controller may control the transfer motor to rotate the transfer member in the first rotation direction and the second rotation direction.

In accordance with an aspect of the present disclosure, a method of controlling a refrigerator including an ice storage for storing the ice cubes includes preventing an ice agglomeration by rotating a transfer member for discharging the ice cubes in a first rotation direction and a second rotation direction, and warning a user of agglomeration of the ice cubes stored in the ice storage, in response to no rotation of the transfer member sensed.

The preventing of the ice agglomeration may include transferring the ice cubes in the opposite direction from an outlet of the ice storage by rotating the transfer member in the first rotation direction, and then transferring the ice cubes toward the outlet by rotating the transfer member in the second rotation direction.

The preventing of the ice agglomeration preventing may include rotating the transfer member in the first rotation direction for a first transfer time period, and then rotating the transfer member in the second rotation direction for a second transfer time period, wherein the first transfer time period is longer than or equal to the second transfer time period.

The warning of the user of the agglomeration of the ice cubes may include displaying an image message for requesting removal of the ice cubes stored in the ice storage, in response to no rotation of the transfer member sensed.

The warning of the user of the agglomeration of the ice cubes may include outputting a sound message for requesting removal of the ice cubes stored in the ice storage, in response to no rotation of the transfer member sensed.

The outputting of the sound message may include outputting the sound message for requesting removal of the ice cubes stored in the ice storage, in response to opening a door of the refrigerator.

The preventing of the ice agglomeration may include preventing the ice agglomeration when a time period elapsed after the ice agglomeration preventing operation terminates is longer than a first reference time period.

The preventing of the ice agglomeration may include preventing the ice agglomeration when an operation time period of a cooling apparatus for supplying cool air to the ice storage after the ice agglomeration preventing operation terminates is longer than a third reference time period.

The preventing of the ice agglomeration may include preventing the ice agglomeration when the number of times a door of the refrigerator opens after the ice agglomeration preventing operation terminates is greater than a first reference number of times.

The preventing of the ice agglomeration may include preventing the ice agglomeration when the number of times a refrigerant pipe included in the ice maker is defrosted after the ice agglomeration preventing operation terminates is greater than a second reference number of times.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
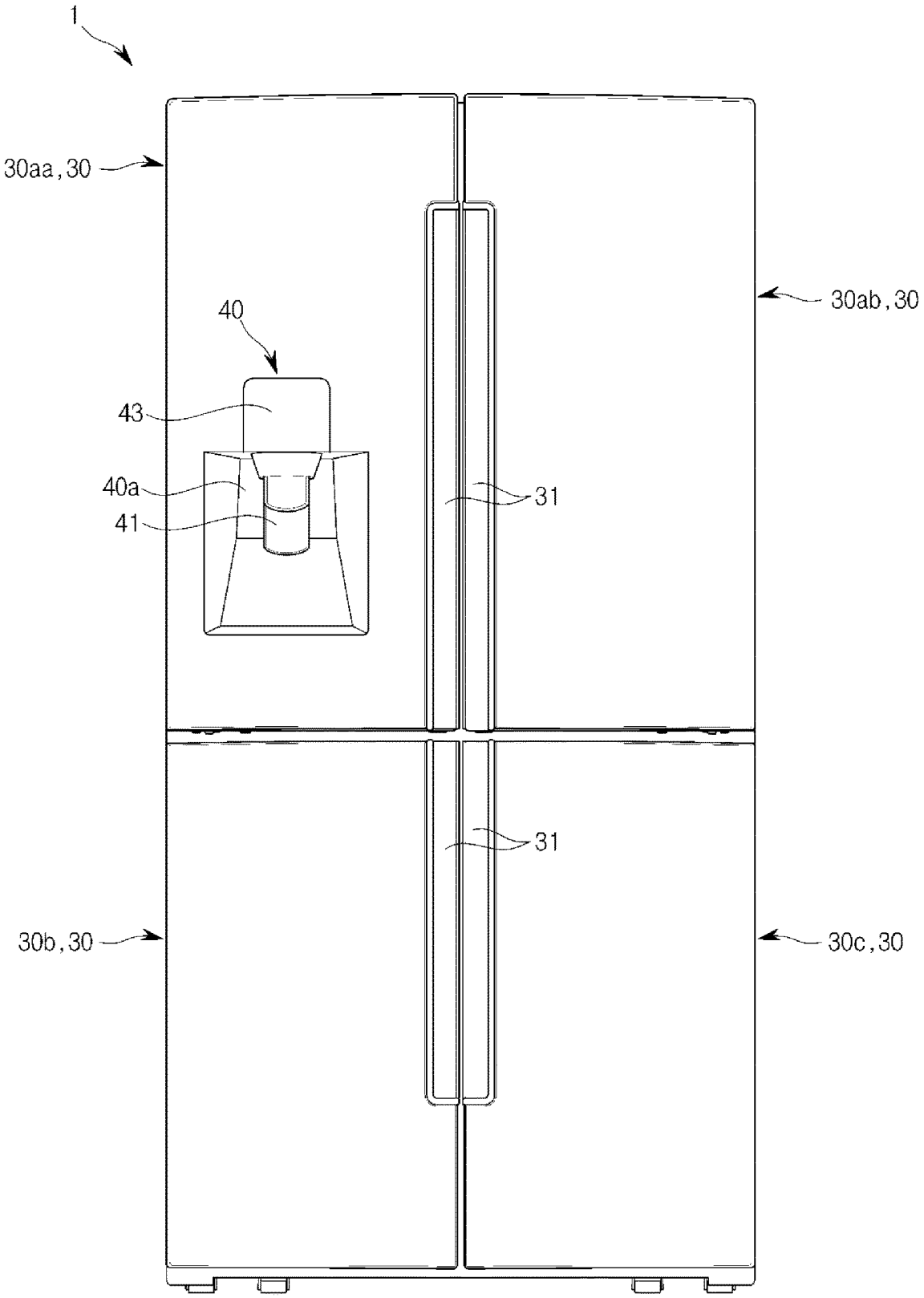
FIG. 1 shows an outer appearance of a refrigerator according to an embodiment.

FIGS. 1 through 21, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Hereinafter, an operating principle and embodiments of the present disclosure will be described in detail with reference to the accompanying drawings.

Figure 2:
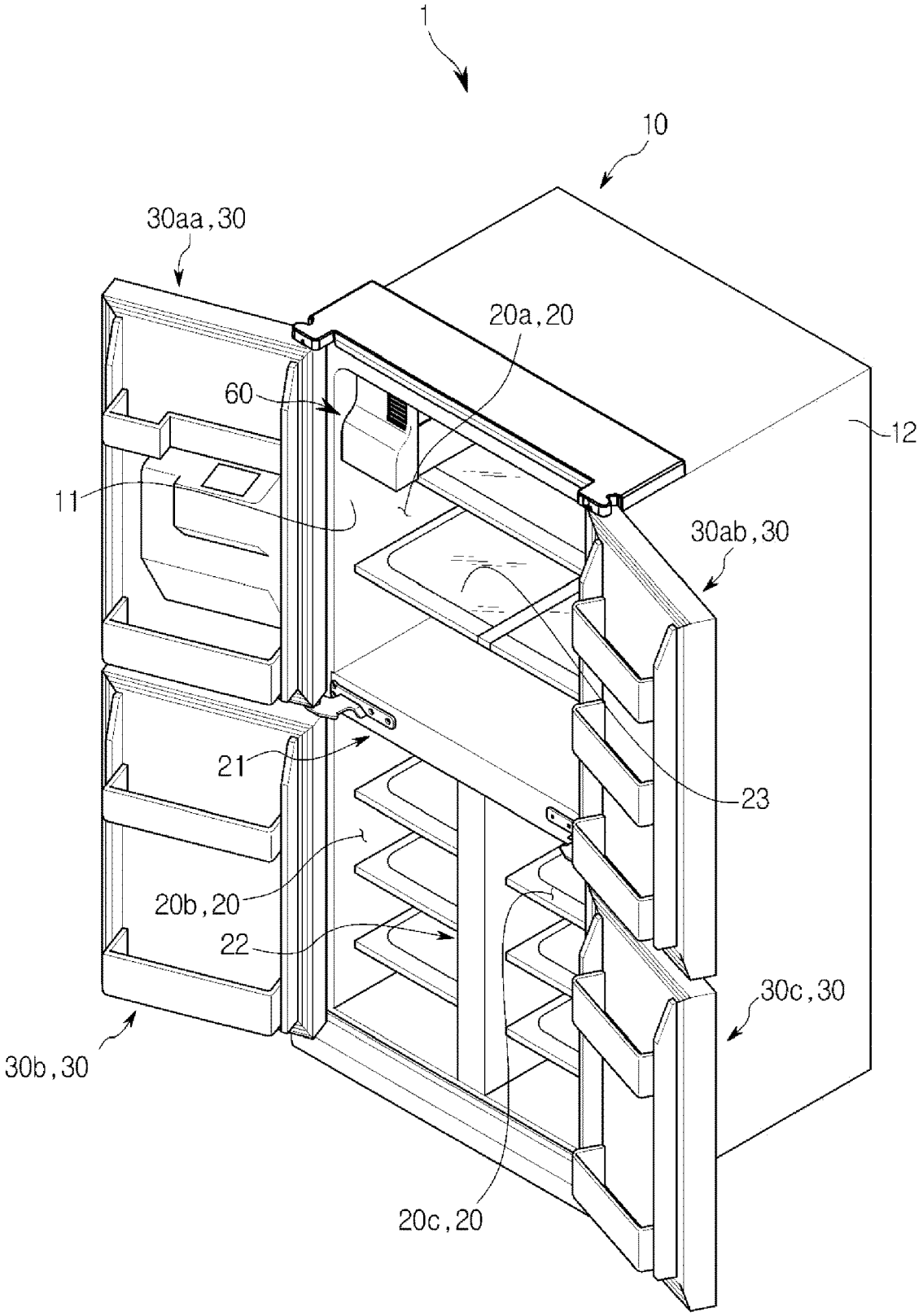
FIG. 2 shows the inside of a refrigerator according to an embodiment.

FIG. 1 shows an outer appearance of a refrigerator according to an embodiment. FIG. 2 shows the inside of a refrigerator according to an embodiment. Also, FIG. 3 illustrates a side vertical-sectional view of a refrigerator according to an embodiment.

Figure 3:
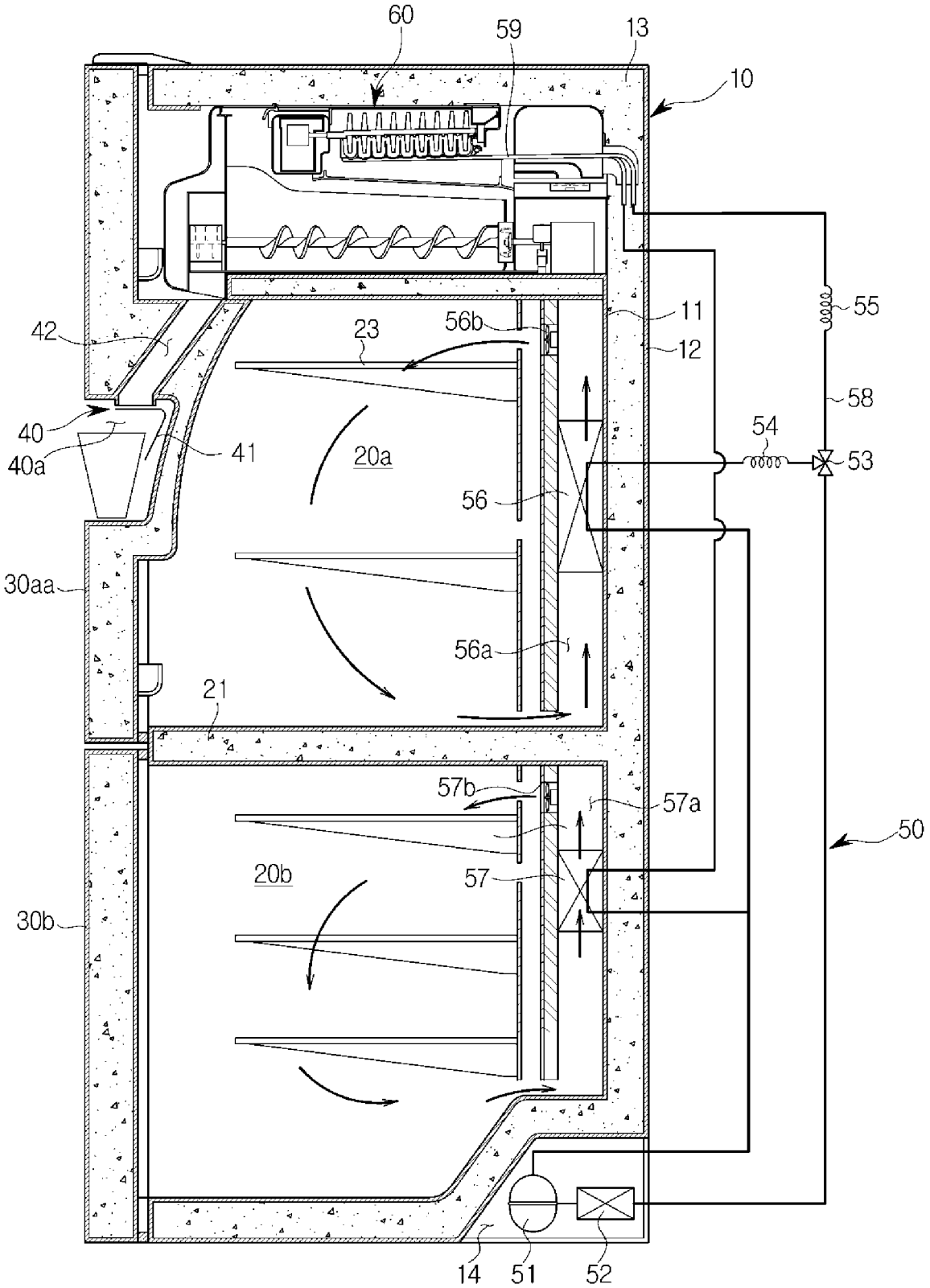
FIG. 3 illustrates a side vertical-sectional view of a refrigerator according to an embodiment.

Referring to FIGS. 1, 2, and 3, a refrigerator 1 may include a main body 10 whose front portion opens, a storage room 20 formed in the inside of the main body 10 and configured to refrigerate and/or freeze food, a door 30 configured to open or close the open front portion of the main body 10, a cooling apparatus 50 configured to freeze the storage room 20, and an ice making apparatus 60 configured to make ice cubes.

The main body 10 may form an outer appearance of the refrigerator 1. The main body 10 may include an inner case 11 forming the storage room 20, and an outer case 12 coupled with an outer portion of the inner case 11. An insulator 13 may be foamed between the inner case 11 and the outer case 12 of the main body 10 in order to prevent cool air from escaping from the storage room 20.

The storage room 20 may be partitioned into a plurality of rooms by a horizontal wall 21 and a vertical wall 22. For example, as shown in FIG. 2, the storage room 20 may be partitioned into an upper storage room 20*a*, a first lower storage room 20*b*, and a second lower storage room 20*c*. Also, the upper storage room 20*a* may refrigerate food, and the lower storage rooms 20*b* and 20*c* may freeze food. In the inside of the storage room 20, one or more shelves 23 may be provided to put food thereon.

The number and arrangement of the storage room 20 are not limited to the embodiment shown in FIG. 2.

The storage room 20 may be opened or closed by the door 30. For example, as shown in FIG. 2, the upper storage room 20*a* may be opened or closed by a first upper door 30*aa* and a second upper door 30*ab*. Also, the first lower storage room 20*b* may be opened or closed by a first lower door 30*b*, and the second lower storage room 20*c* may be opened or closed by a second lower door 30*c*.

A handle 31 may be installed on the door 30 to enable a user to easily open or close the door 30. The handle 31 may extend longitudinally along between the first upper door 30*aa* and the second upper door 30*ab* and between the first lower door 30*b* and the second lower door 30*c*. As a result, when the door 30 is closed, the handle 31 may look as if it is one body with the door 30.

The number and arrangement of the door 30 are not limited to the embodiment shown in FIG. 2.

In an area of the door 30, a dispenser 40 may be provided. The dispenser 40 may discharge water and/or ice cubes in response to a user's input. In other words, the user may take water and/or ice cubes through the dispenser 40 without having to open the door 30.

The dispenser 40 may include a dispenser lever 41 to which a user's discharge instruction is input, a dispenser chute 42 through which ice cubes are discharged from the ice making apparatus 60, and a dispenser display panel 43 displaying an operation state of the dispenser 40.

The dispenser 40 may be installed in the door 30 or in an outer area of the main body 10. For example, as shown in FIG. 0.1, the dispenser 40 may be installed in the first upper door 30*aa*. However, the position of the dispenser 40 is not limited to the first upper door 30*aa*. That is, the dispenser 40 may be positioned at any other location at which the user can take water and/or ice cubes, such as the second upper door 30*ab*, the first lower door 30*b*, the second lower door 30*c*, and the outer case 12 of the main body 10.

The cooling apparatus 50 may include, as shown in FIG. 3, a compressor 51 to compress refrigerants to high pressure, a condenser 52 to condense the compressed refrigerants, an expander 54 and 55 to expand the refrigerants to low pressure, an evaporator 56 and 57 to evaporate the refrigerants, and a refrigerant pipe 58 to guide the refrigerants.

The compressor 51 and the condenser 52 may be located in a machine room 14 provided in rear, lower space of the main body 10.

The evaporator 56 and 57 may include a first evaporator 56 to supply cool air to the upper storage room 20*a*, and a second evaporator 57 to supply cool air to the lower storage rooms 20*b* and 20*c*. The first evaporator 56 may be disposed in a first cool-air duct 56*a* formed in rear space of the upper storage room 20*a*, and the second evaporator 57 may be disposed in a second cool-air duct 57*a* formed in rear space of the lower storage rooms 20*b* and 20*c*.

In the first cool-air duct 56*a*, a first blow fan may be disposed to supply cool air generated by the first evaporator 56 to the upper storage room 20*a*, and in the second cool-air duct 57*a*, a second blow fan may be disposed to supply cool air generated by the second evaporator 57 to the lower storage rooms 20*b* and 20*c*.

The refrigerant pipe 58 may guide refrigerants compressed by the compressor 51 to the first evaporator 56 and the second evaporator 57 or to the ice making apparatus 60. In the refrigerant pipe 58, a switching valve 53 may be installed to distribute refrigerants to the first evaporator 56 or the second evaporator 57 or to the ice making apparatus 60.

A portion (hereinafter, also referred to as an "ice making refrigerant pipe") 59 of the refrigerant pipe 58 may extend to the inside of the ice making apparatus 60, and the ice making refrigerant pipe 59 disposed in the inside of the ice making apparatus 60 may freeze water contained in the ice making apparatus 60 to make ice cubes.

The ice making apparatus 60 may make ice cubes using cool air supplied from the ice making refrigerant pipe 59, and may be disposed in the storage room 20. For example, as shown in FIG. 2, the ice making apparatus 60 may be disposed in a left, upper area of the upper storage room 20*a* to correspond to the dispenser 40 installed in the first upper door 30*aa*.

However, the location of the ice making apparatus 60 is not limited to the embodiment shown in FIG. 2, and the ice making apparatus 60 may be installed in the lower storage rooms 20*b* and 20*c* or in the horizontal wall 21 between the upper storage room 20*a* and the lower storage rooms 20*b* and 20*c*.

Figure 4:
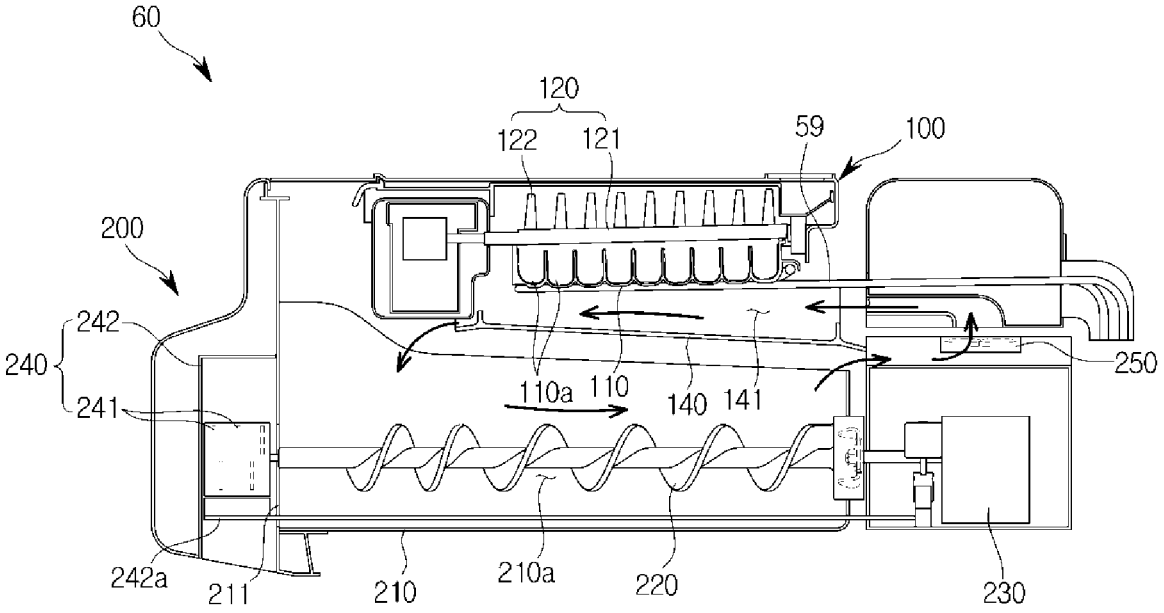
FIG. 4 illustrates a side vertical-sectional view of an ice making apparatus included in a refrigerator according to an embodiment.
Figure 5:
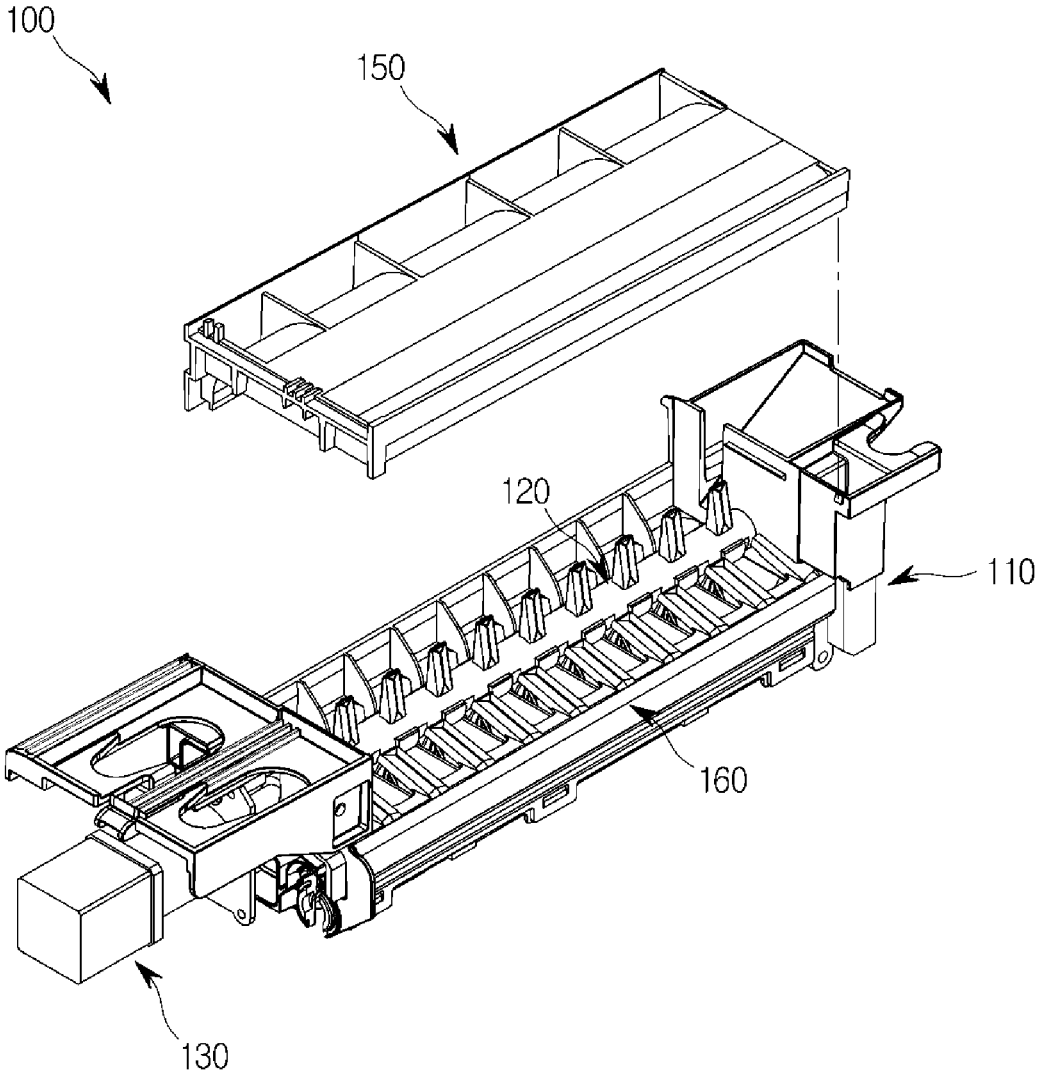
FIG. 5 shows an outer appearance of an ice maker included in a refrigerator according to an embodiment.
Figure 6:
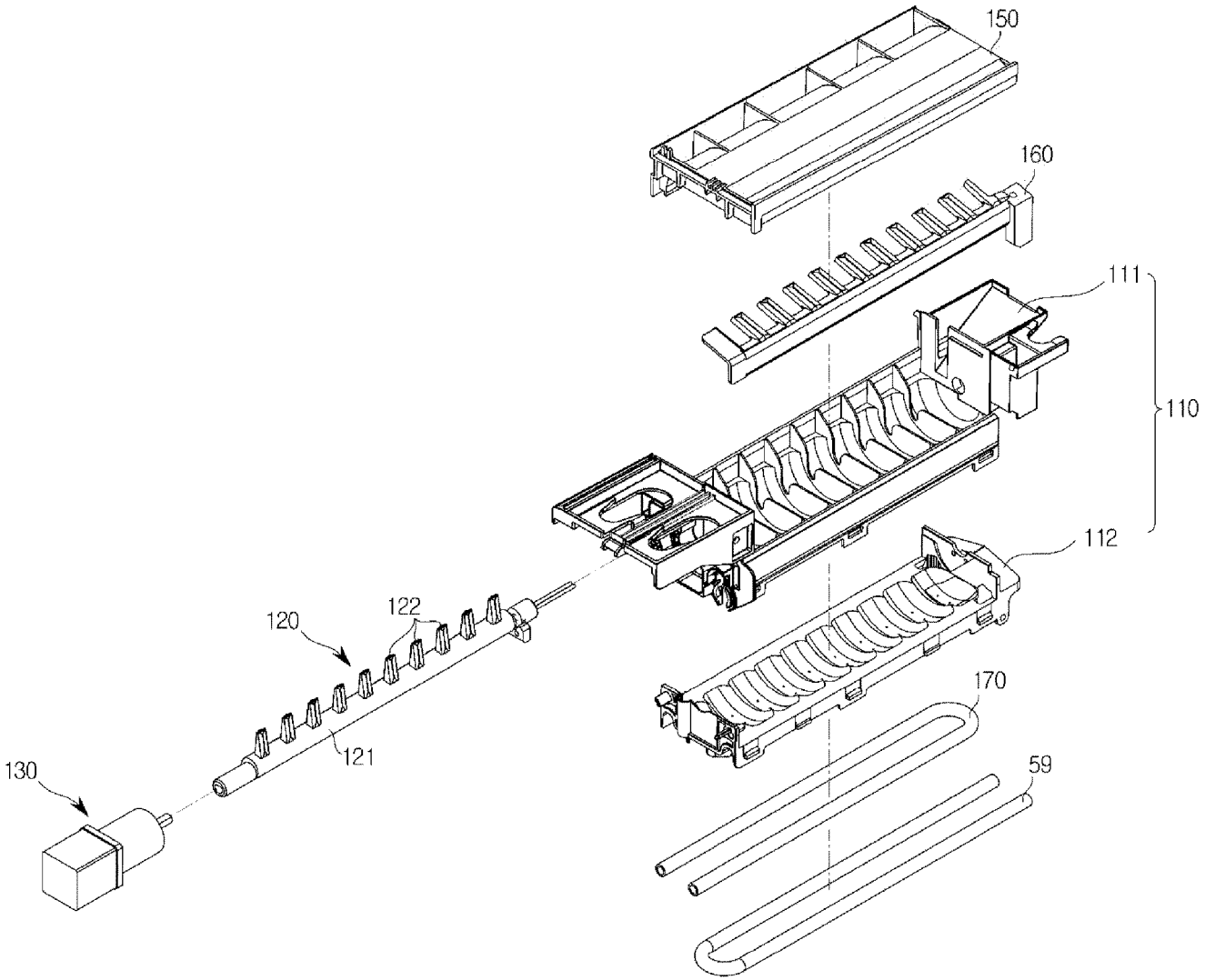
FIG. 6 illustrates an exploded perspective view of an ice maker included in a refrigerator according to an embodiment.
Figure 7:
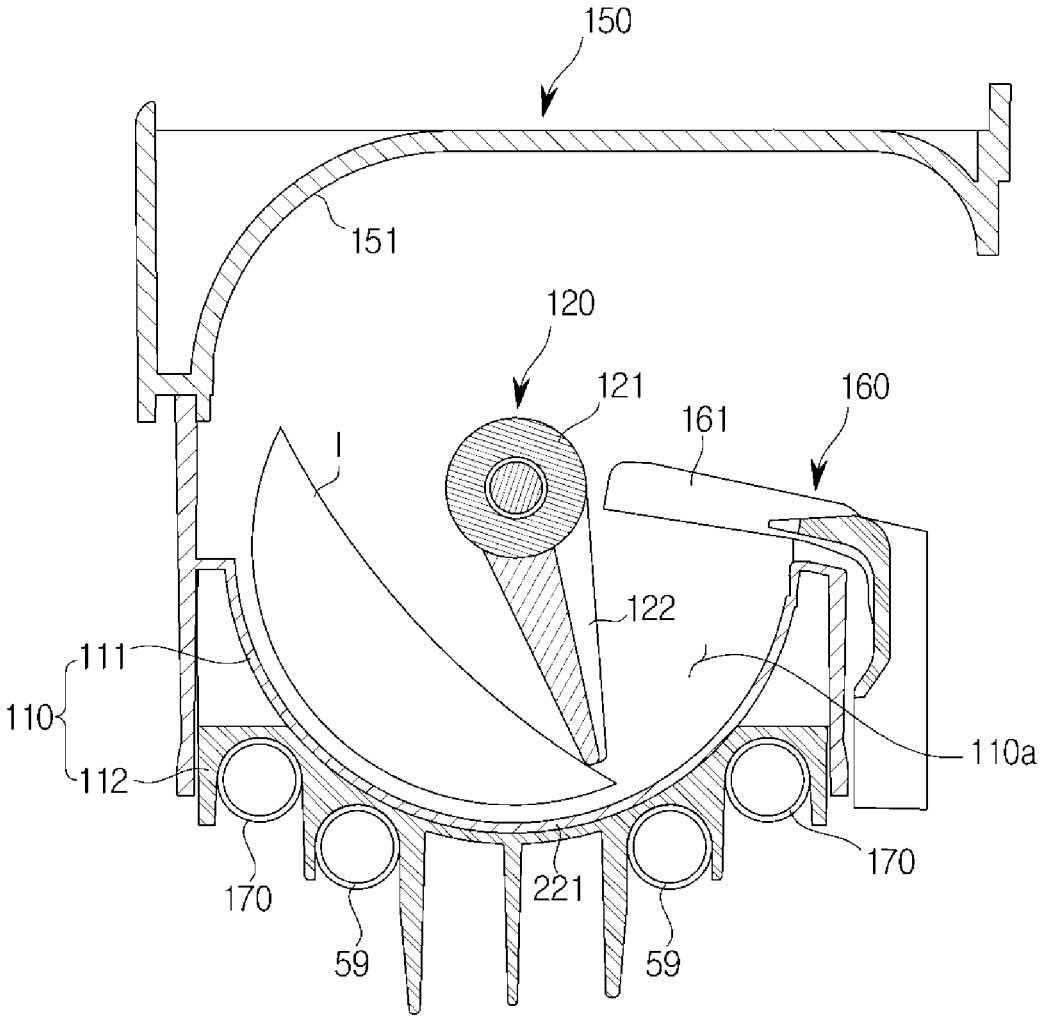
FIG. 7 illustrates a sectional view of an ice maker included in a refrigerator according to an embodiment when the ice maker discharges ice cubes.
Figure 8:
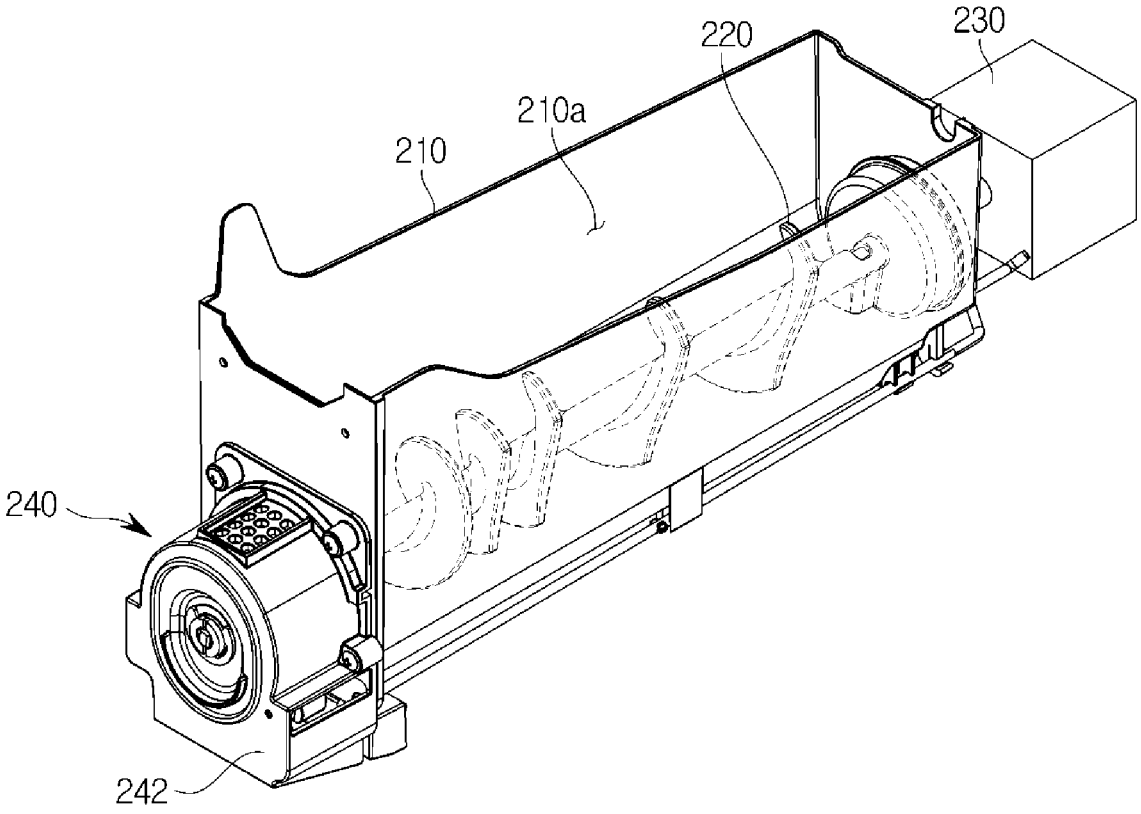
FIG. 8 shows an outer appearance of an ice storage included in a refrigerator according to an embodiment.
Figure 9:
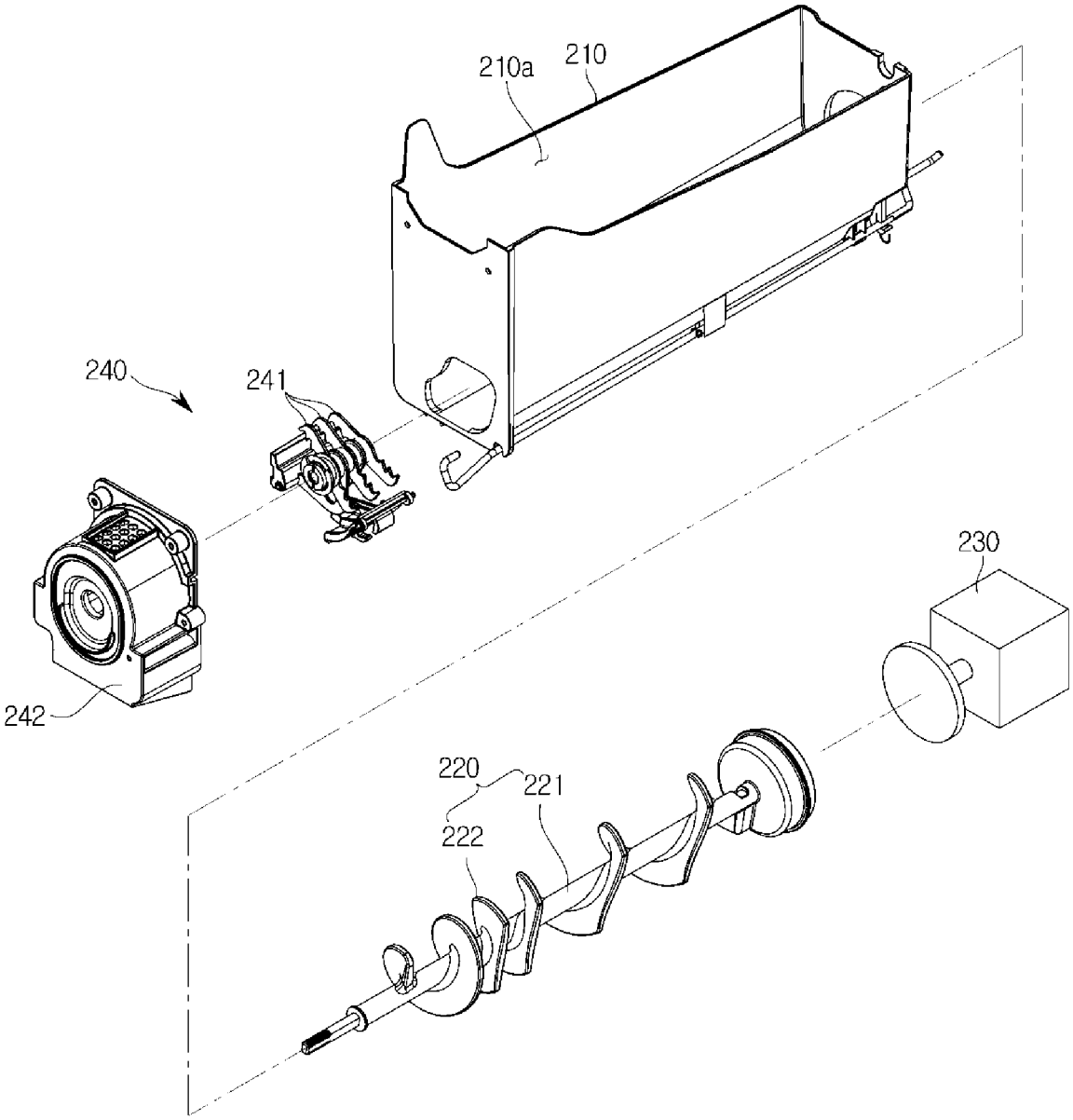
FIG. 9 illustrates an exploded perspective view of an ice storage included in a refrigerator according to an embodiment.
Figure 10:
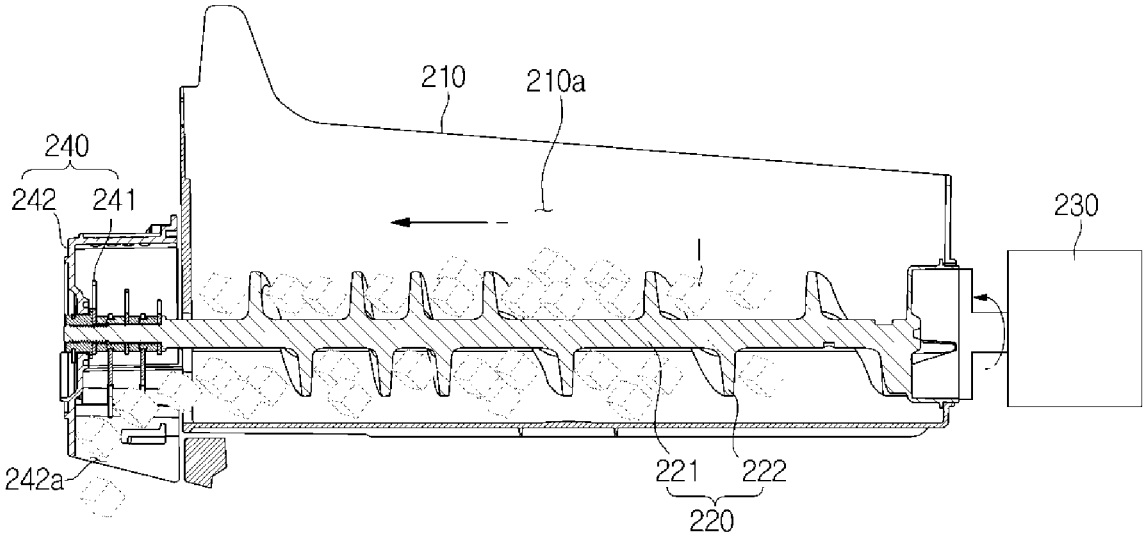
FIG. 10 illustrates a sectional view of an ice storage included in a refrigerator according to an embodiment when the ice storage discharges ice cubes.

FIG. 4 illustrates a side vertical-sectional view of an ice making apparatus included in a refrigerator according to an embodiment. FIG. 5 shows an outer appearance of an ice maker included in a refrigerator according to an embodiment. FIG. 6 illustrates an exploded perspective view of an ice maker included in a refrigerator according to an embodiment. FIG. 7 illustrates a sectional view of an ice maker included in a refrigerator according to an embodiment when the ice maker discharges ice cubes. FIG. 8 shows an outer appearance of an ice storage included in a refrigerator according to an embodiment. FIG. 9 illustrates an exploded perspective view of an ice storage included in a refrigerator according to an embodiment. FIG. 10 illustrates a sectional view of an ice storage included in a refrigerator according to an embodiment when the ice storage discharges ice cubes.

Referring to FIGS. 4 to 10, the ice making apparatus 60 may include an ice maker 100 and an ice storage 200.

The ice maker 100 may make ice cubes, and discharge the ice cubes to the ice storage 200.

The ice storage 200 may store the ice cubes made by the ice maker 100. The ice storage 200 may discharge the stored ice cubes through the dispenser 40 in response to a user instruction input through the dispenser lever 41. For example, when the user presses the dispenser lever 41, the ice storage 200 may discharge ice cubes to the outside through the dispenser 40.

As shown in FIGS. 5, 6, and 7, the ice maker 100 may include an ice making tray 110 which stores water for making ice cubes and in which ice cubes are made, an ice discharging portion 120 configured to separate the ice cubes made in the ice making tray 110 from the ice making tray 110, an ice discharging motor 130 configured to rotate the ice discharging portion 120, an ice making cover 150 guiding the ice cubes separated from a first ice making tray 111 to the ice storage 200, a slider 160 configured to prevent the ice cubes separated from the ice making tray 110 from returning to the first ice making tray 111, an ice discharging heater 170 configured to heat the ice making tray 110 to separate the ice cubes from the ice making tray 110, and a cool air duct 140 guiding cool air from the ice making refrigerant pipe 59 to the ice storage 200.

The ice making tray 110 may include the first ice making tray 111 storing water for making ice cubes, and a second ice making tray 112 contacting the ice making refrigerant pipe 59.

The first ice making tray 111 may include a plurality of ice making cells 110*a*, and each ice making cell 110*a* may store water for making an ice cube. Also, the first ice making tray 111 may be rested on the second ice making tray 112, and cooled by the second ice making tray 112.

The second ice making tray 112 may be made of a material having high heat conductivity, and below the second ice making tray 112, the ice making refrigerant pipe 59 may be positioned. The ice making tray 110 may be cooled to below the freezing point (zero degrees Celsius) of water by the ice making refrigerant pipe 59. Also, the second ice making tray 112 may cool the first ice making tray 111, and water stored in the ice making cells 110*a* of the first ice making tray 111 may be frozen to make ice cubes.

The ice discharging portion 120 may be positioned above the ice making tray 110, and after ice cubes are made, the ice discharging portion 120 may separate the ice cubes from the ice making tray 110.

The ice discharging portion 120 may include a scooping shaft 121 that is rotatable, and a scooping blade 122 configured to separate ice cubes from the ice making tray 110.

The scooping shaft 121 may pass through a through hole of the ice making tray 110 to be positioned above the ice making tray 110. For example, the scooping shaft 121 may be installed at an appropriate height from the ice making tray 110 such that at least one of the scooping blade 122 can be located in the ice making cells 110*a* when the scooping blade 122 is located downward.

The scooping shaft 121 may be connected to the ice discharging motor 130, and receive a rotational force from the ice discharging motor 130 to rotate in a clockwise or counterclockwise direction.

The scooping blade 122 may protrude from a side wall of the scooping shaft 121.

There may be provided a plurality of scooping blades 122 along an axial direction of the scooping shaft 121. The number of the plurality of scooping blades 122 may be equal to that of the plurality of ice making cells 110*a* of the ice making tray 110, and the locations of the plurality of scooping blades 122 may correspond to those of the plurality of ice making cells 110*a*.

The scooping blades 122 may rotate on the scooping shaft 121 when the scooping shaft 121 rotates, and when the scooping blades 122 rotate, at least one of the scooping blades 122 may be positioned in the ice making cells 110*a*.

When the scooping blades 122 rotate, the scooping blades 122 may separate ice cubes made in the ice making tray 110 from the ice making tray 110. More specifically, when the scooping blades 122 rotate in the clockwise or counterclockwise direction on the scooping shaft 121, the scooping blades 122 may separate ice cubes from the ice making tray 110, and push the ice cubes out of the ice making tray 110.

For example, as shown in FIG. 7, if the scooping shaft 121 rotates in the clockwise direction, the scooping blades 122 may rotate in the clockwise direction on the scooping shaft 121. Also, when the scooping blades 122 rotate in the clockwise direction, the scooping blades 122 may raise ice cubes I in the clockwise direction.

The ice discharging motor 130 may generate a rotational force to rotate the ice discharging portion 120 in the clockwise or counterclockwise direction.

The ice discharging motor 130 may be connected to the scooping shaft 121 of the ice discharging portion 120, and a rotational force of the ice discharging motor 130 may be transferred to the scooping shaft 121 of the ice discharging portion 120. For example, the ice discharging motor 130 may rotate at 1 rpm (revolution per minute) to 6 rpm to enable the scooping blades 122 to separate the ice cubes I from the ice making tray 110. Also, the ice discharging motor 130 may rotate about 360 degrees such that the scooping blades 122 make one full revolution on the scooping shaft 121.

The ice discharging motor 130 may include a Direct Current (DC) motor rotating in response to supply of DC power, an Alternating Current (AC) motor rotating in response to supply of AC power, or a step motor rotating in response to supply of a plurality of pulses.

The ice making cover 150 may guide the ice cubes I separated from the ice making tray 110 to the ice storage 200. As shown in FIG. 7, an inner wall 151 of the ice making cover 150 may extend from inside surfaces of the ice making cells 110*a* of the ice making tray 110, and have a curved surface for guiding the ice cubes I to the ice storage 200.

The ice cubes I separated from the ice making tray 110 may move along the inner walls of the ice making cells 110*a* and the inner wall 151 of the ice making cover 150, when the scooping blades 122 rotate, as shown in FIG. 7. In other words, the ice cubes I may make a full revolution around the scooping shaft 121 when the scooping blades 122 rotate.

The slider 160 may include a plurality of guide protrusions 161 protruding from the ice making tray 110 toward the scooping shaft 121 of the ice discharging portion 120.

Spaces between the plurality of guide protrusions 161 may be wider than widths of the scooping blades 122 so that the scooping blades 122 can pass through the spaces between the plurality of guide protrusions 161. Also, the spaces between the plurality of guide protrusions 161 may be narrower than widths of the ice making cells 110*a* so that the ice cubes I cannot pass through the spaces between the plurality of guide protrusions 161. Accordingly, the guide protrusions 161 of the slider 160 may not interfere with a rotation of the scooping blades 122, and may not pass the ice cubes I through.

The ice cubes I raised by the scooping blades 122 may be guided to the slider 160 along the inner wall 151 of the ice making cover 150. The ice cubes I may fall downward along the guide protrusions 161 of the slider 160, without passing through the guide protrusions 161. In other words, the ice cubes I may be put into the ice storage 200 along the guide protrusions 161.

The ice making refrigerant pipe 59 may have a "U" shape, and directly contact a lower surface of the second ice making tray 112.

Liquid refrigerants decompressed by the expander 55 may flow through the inside of the ice making refrigerant pipe 59. The decompressed liquid refrigerants may be vaporized when passing through the ice making refrigerant pipe 59, and when the liquid refrigerants are vaporized, the refrigerants may absorb heat from the second ice making tray 112. In other words, the refrigerants can cool the second ice making tray 112.

In this way, the second ice making tray 112 may be cooled by contacting the ice making refrigerant pipe 59.

The ice discharging heater 170 may have a "U" shape. The ice discharging heater 170 may be opposite to the ice making refrigerant pipe 59. In other words, in the ice making refrigerant pipe 59, the open portion of the "U" shape may be toward the rear portion of the ice maker 100, whereas in the ice discharging heater 170, the open portion of the "U" shape may be toward the front portion of the ice maker 100.

The ice discharging heater 170 may be an electrical resistor, and when current is supplied to the ice discharging heater 170, the ice discharging heater 170 may emit heat by electrical resistance.

Also, the ice discharging heater 170 may directly contact the lower surface of the second ice making tray 112 to directly heat the second ice making tray 112.

More specifically, the ice discharging heater 170 may heat the ice making tray 110 in order to smoothly separate ice cubes from the ice making tray 110. When the ice making tray 110 is heated, a part of ice cubes contacting the ice making tray 110 may melt, and accordingly, the ice cubes can easily move along the inner wall of the ice making tray 110.

Also, the ice discharging heater 170 may be used to defrost the ice making refrigerant pipe 59. When the ice making refrigerant pipe 59 operates, frost may be formed on the surface of the ice making refrigerant pipe 59. The frost formed on the surface of the ice making refrigerant pipe 59 may reduce heat-exchange efficiency of the ice making refrigerant pipe 59. Accordingly, the refrigerator 1 may operate the ice discharging heater 170 to remove frost formed on the surface of the ice making refrigerator pipe 59.

The cool air duct 140 may be positioned below the ice making tray 110, and form a cool air path through which cool air flows, to supply cool air of the ice making refrigerant pipe 59 to the ice storage 200.

Inside air of the cool air duct 140 may be cooled by the ice making refrigerant pipe 59 and/or the ice making tray 110. The air cooled by the ice making refrigerant pipe 59 and/or the ice making tray 110 may flow to the ice storage 200 along the inside of the cool air duct 125, that is, along the cool air path 141. Due to the cool air entered the ice storage 200, the ice storage 200 can be maintained at below zero temperatures, and ice cubes stored in the ice storage 200 may not melt.

As shown in FIGS. 8, 9, and 10, the ice storage 200 may include an ice bucket 210 storing ice cubes made by the ice maker 100, a transfer member 220 configured to transfer the ice cubes stored in the ice bucket 210 to an outlet 211, a transfer motor 230 configured to drive the transfer member 220, a crusher 240 configured to selectively crush ice cubes discharged to the outlet 211, and an ice storage fan 250 to circulate inside air of the ice maker 100 and the ice storage 200.

The ice bucket 210 may be positioned below the ice maker 100, and form an ice storage room 210*a* in which ice cubes can be stored. Ice cubes separated from the ice making tray 110 by the ice discharging portion 120 may be stored in the ice storage room 210*a*.

The ice cubes may be separated from the ice making tray 110 by the ice discharging portion 120, and then fall into the ice bucket 210. The ice cubes fallen into the ice bucket 210 may be stored in the ice bucket 210 until an ice discharge instruction is input by a user.

In a front portion of the ice bucket 210, an outlet 211 may be formed to discharge the ice cubes from the ice bucket 210.

The transfer member 220 may be disposed in the inside of the ice bucket 210, that is, in the ice storage room 210*a* to transfer the ice cubes stored in the ice bucket 210 toward the outlet 211 of the ice bucket 210.

The transfer member 220 may be in the shape of an auger. The transfer member 220 may include a transfer shaft 221 that is rotatable in the clockwise or counterclockwise direction, and a transfer member 220 that is formed in a spiral shape along the outer surface of the transfer shaft 221. Also, the transfer member 220 may be a wire formed in a spiral shape.

When the transfer member 220 rotates, the ice cubes stored in the ice bucket 210 may be transferred to the outlet 211 or in the opposite direction from the outlet 211.

In the transfer member 220 shown in FIGS. 8, 9, and 10, the ice cubes may be transferred in the opposite direction from the outlet 211 when the transfer shaft 221 rotates in the clockwise direction (hereinafter, referred to as a "first rotation direction"). Also, when the transfer shaft 221 rotates in the counterclockwise direction (hereinafter, referred to as a "second rotation direction"), the ice cubes may be transferred toward the outlet 211.

In FIGS. 8, 9, and 10, the transfer member 220 including the transfer shaft 221 and the spiral transfer blade 222 is shown. However, the transfer member 220 may include a wire formed in a spiral shape. The transfer member 220 including a spiral wire may also transfer ice cubes toward the outlet 211 or in the opposite direction from the outlet 211, according to a rotation direction.

The transfer motor 230 may rotate the transfer member 220 in the first rotation direction or in the second rotation direction.

For example, the transfer motor 230 may rotate in the second rotation direction in response to pressure applied on the dispenser lever 41, as shown in FIG. 10. When the transfer motor 230 rotates in the second rotation direction, the transfer member 220 may transfer the ice cubes I stored in the ice bucket 210 toward the outlet 211. The ice cubes I transferred toward the outlet 211 may be discharged through the outlet 211, and the discharged ice cubes I may be discharged out of the refrigerator 1 along the dispenser chute 42.

According to another example, the transfer motor 230 may rotate in the first rotation direction. When the transfer motor 230 rotates in the first rotation direction, the transfer member 220 may transfer the ice cubes I stored in the ice bucket 210 in the opposite direction from the outlet 211. When the ice cubes I are transferred in the opposite direction from the outlet 211, an external force may be applied to the ice cubes I, and ice cubes agglomerated in the ice storage room 210*a* may be separated by the external force.

If ice cubes are stored for a long time in the ice storage room 210*a*, the ice cubes stored in the ice storage room 210*a* may be stuck together due to various causes, and as a result, the ice cubes may agglomerate together. For example, the surfaces of ice cubes may melt due to friction between the ice cubes so that the ice cubes agglomerate together, or when ice cubes are separated from the ice making tray 110, the surfaces of the ice cubes may melt to agglomerate with ice cubes stored in the ice storage room 210*a*.

Also, air between ice cubes may be frozen by sublimation of the ice cubes so that the ice cubes agglomerate together. In other words, the water vapor between ice cubes may sublimate (water vapor→ice) so that the ice cubes are stuck together to agglomerate.

If the ice cubes agglomerate together, the transfer member 220 may transfer the ice cubes stored in the ice bucket 210 in the opposite direction from the outlet 211 to thereby separate cubed ice from the agglomerated ice cubes. Separating the cubed ice from the agglomerated ice cubes may be different from crushing ice cubes through the crusher 240 which will be described later. Separating ice cubes through the transfer member 220 means separating agglomerated ice cubes in order to maintain the state of cubed ice, and crushing ice cubes through the crusher 240 means crushing cubed ice to crushed ice.

Separating ice cubes through the transfer member 220 will be described in more detail, below.

Also, the transfer motor 230 may output information about a rotation when it rotates. For example, the transfer motor 230 may output information about a rotation direction (for example, the first rotation direction or the second rotation direction) or information about rpm. Also, the transfer motor 230 may output information about driving current when it rotates.

The transfer motor 230 may be a DC motor rotating in response to supply of DC power, an AC motor rotating in response to supply of AC power, or a step motor rotating in response to supply of a plurality of pulses.

The crusher 240 may include a plurality of crush blades 241 configured to crush ice cubes, and a crush cover 242 surrounding the plurality of crush blades 241.

The crush blades 241 may crush ice cubes discharged through the outlet 211.

The ice making apparatus 60 may discharge cubed ice or crushed ice according to a user's selection.

If cubed ice is selected by the user, the ice cubes may be discharged without being crushed by the crush blades 241. In other words, ice cubes made in the ice making cells 110*a* of the ice making tray 110 may be discharged, as they are in the shape of the ice making cells 110*a*, to the outside through the dispenser 40.

If crushed ice is selected by the user, the ice cubes may be crushed by the crush blades 241, and then discharged. More specifically, ice cubes passed through the outlet 211 may be crushed by the crush blades 241, and then discharged to the outside through the dispenser 40.

The crush cover 242 may accommodate the crush blades 241 so that the crush blades 241 are not exposed to the outside.

Also, below the crush cover 242, an outlet 242*a* may be provided to discharge ice cubes. Ice cubes crushed by the crush blades 241 may be discharged through the outlet 242*a* of the crush cover 242.

The ice storage fan 250 may circulate cool air in the cool air duct 125 to the ice bucket 210. For example, the ice storage fan 250 may inhale air in the ice bucket 210, and discharge the inhaled air to the cool air duct 125, as shown in FIG. 4. As a result, the air may be cooled by the ice making refrigerant pipe 59 and/or the ice making tray 110 in the inside of the cool air duct 125, and then, the cooled air may again flow to the ice bucket 210. As a result, inside air of the ice storage 200 can be maintained at below zero temperatures.

As described above, the ice maker 100 may make ice cubes, and the ice storage 200 may store the ice cubes made by the ice maker 100. The ice storage 200 may discharge the ice cubes according to the user's selection. Also, the ice storage 200 may apply an external force to the ice cubes using the transfer member 220 in order to prevent the stored ice cubes from agglomerating together.

Figure 11:
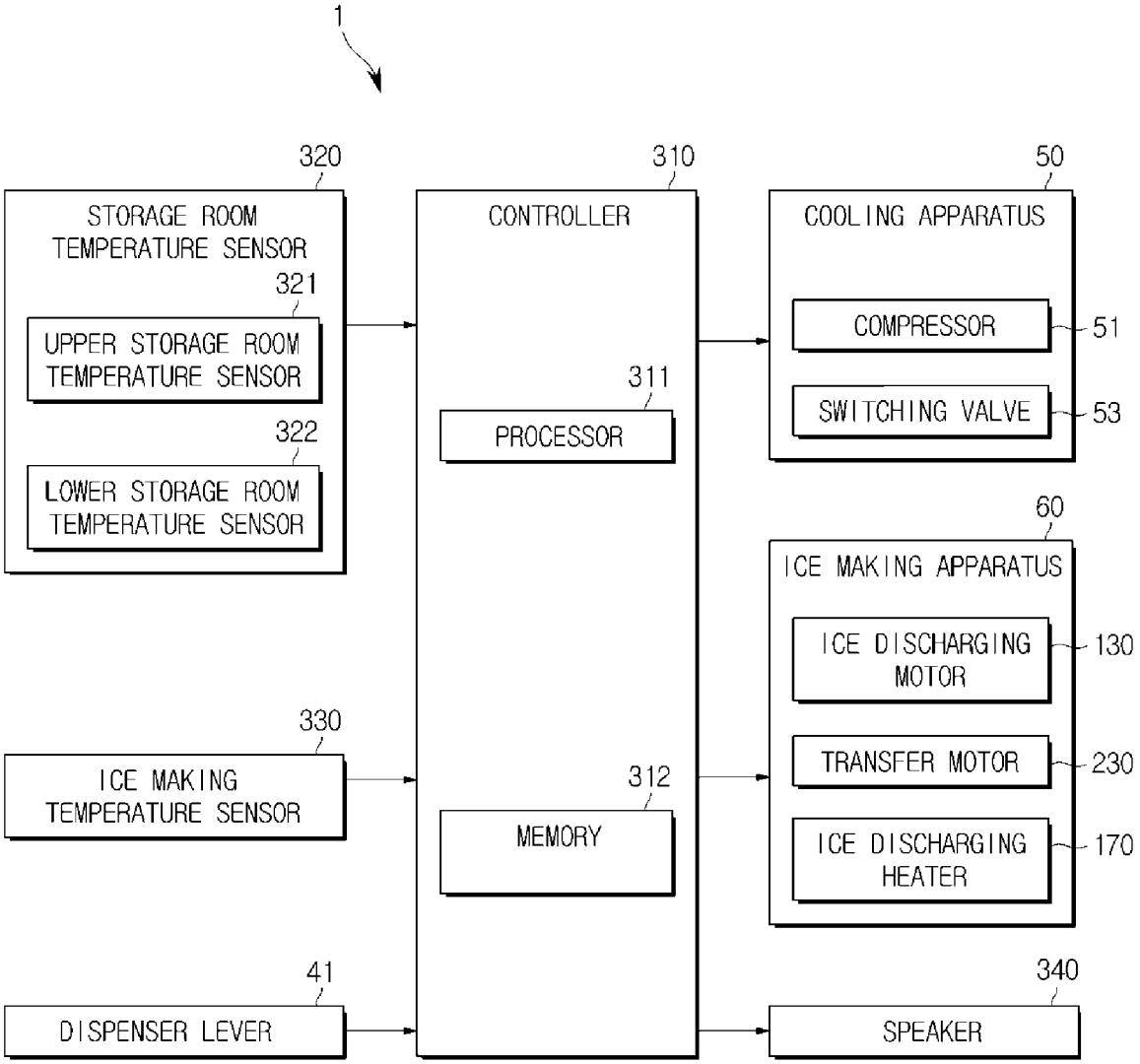
FIG. 11 shows a control configuration of a refrigerator according to an embodiment.

FIG. 11 shows a control configuration of a refrigerator according to an embodiment.

As shown in FIG. 11, the refrigerator 1 may further include, in addition to the components shown in FIGS. 1 to 10, a storage room temperature sensor 320 configured to measure temperature of the storage room 20, an ice making temperature sensor 330 configured to measure temperature of the ice making apparatus 60, the dispenser lever 41 to which an ice discharge instruction is input, the cooling apparatus 50 configured to cool the storage room 20, the ice making apparatus 60 to make and store ice cubes, a speaker 340 configured to output sound, and a controller 310 configured to control the cooling apparatus 50 according to an output of the storage room temperature sensor 320, and to control the ice making apparatus 60 according to an output of the ice making temperature sensor 330.

The storage room temperature sensor 320 may include an upper storage room temperature sensor 321 for measuring temperature of the upper storage room 20*a* (see FIG. 3), and a lower storage room temperature sensor 322 for measuring temperature of the lower storage room 20*b* (see FIG. 3).

The upper storage room temperature sensor 321 may be installed in the upper storage room 20*a* to measure temperature of the upper storage room 20*a* and to output an electrical signal corresponding to the temperature of the upper storage room 20*a* to the controller 310. For example, the upper storage room temperature sensor 321 may be a thermistor whose electrical resistance value changes according to temperature.

The lower storage room temperature sensor 322 may be installed in the lower storage room 20*b* to measure temperature of the lower storage room 20*b* and to output an electrical signal corresponding to the temperature of the lower storage room 20*b* to the controller 310. For example, the lower storage room temperature sensor 322 may be a thermistor whose electrical resistance value changes according to temperature.

The ice making temperature sensor 330 may be installed in the ice making apparatus 60. For example, the ice making temperature sensor 330 may be installed in the ice making tray 110 in which water for making ice cubes is stored.

The ice making temperature sensor 330 may measure temperature of water or ice cubes accommodated in the ice making tray 110, and output an electrical signal corresponding to the temperature of the water or ice cubes to the controller 310. For example, the ice making temperature sensor 330 may be a thermistor whose electrical resistance value changes according to temperature.

The dispenser lever 41 may be installed in the door 30, and a user's instruction for discharging ice cubes may be input to the dispenser lever 41. For example, if the dispenser lever 41 is pressed by the user, the ice making apparatus 60 may discharge ice cubes to the outside through the dispenser 40.

The cooling apparatus 50 may include, as described above with reference to FIG. 3, the compressor 51, the condenser 52, the expander 54 and 55, the evaporator 56 and 57, the refrigerant pipe 58, and the switching valve 53.

The compressor 51 may compress refrigerants to high pressure in response to a control signal from the controller 310, and discharge the compressed refrigerants to the condenser 52. Also, the switching valve 53 may supply refrigerants to at least one of the evaporator 56 of the upper storage room 20*a* and the evaporator 57 of the lower storage room 20*b* in response to a control signal from the controller 310. In other words, the compressor 51 may generate the flow of refrigerants in response to a control signal from the controller 310, and the switching valve 53 may control a flow path of the refrigerants.

The ice making apparatus 60 may include the ice maker 100 for making ice cubes, and the ice storage 200 storing the ice cubes. The ice maker 100 may include the ice making tray 110, the ice discharging portion 120, the ice discharging motor 130, the ice making cover 150, the slider 160, the ice discharging heater 170, and the cool air duct 140. Also, the ice storage 200 may include the ice bucket 210, the transfer member 220, the crusher 240, and the ice storage fan 250. The ice discharging motor 130 may drive the ice discharging portion 120 in response to a control signal from the controller 310 to separate ice cubes from the ice making tray 110. Also, the transfer motor 230 may drive the transfer member 220 in response to a control signal from the controller 310 to discharge ice cubes.

The speaker 340 may output sound corresponding to an electrical sound signal output from the controller 310. More specifically, the speaker 340 may receive an electrical sound signal from the controller 310, and convert the electrical sound signal to sound.

The controller 310 may include memory 312 storing programs and data for controlling operations of the refrigerator 1, and a processor 311 configured to generate control signals for controlling the operations of the refrigerator 1 according to the programs and data stored in the memory 312. The processor 311 and the memory 312 may be implemented as separate chips or as a signal chip.

The memory 312 may store control programs and control data for controlling operations of the refrigerator 1, and various application programs and application data for performing various functions according to a user's inputs. Also, the memory 312 may temporarily store an output of the storage room temperature sensor 320, an output of the ice making temperature sensor 330, and an output of the processor 311.

The memory 312 may include volatile memory, such as Static-Random Access Memory (S-RAM) and Dynamic-Random Access Memory (D-RAM), for temporarily storing data. Also, the memory 312 may include non-volatile memory, such as Read Only Memory (ROM), Erasable Programmable Read Only Memory (EPROM), and Electrically Erasable Programmable Read Only Memory (EEPROM), for storing data for a long time.

The processor 311 may include various logic circuits and operation circuits, and process data according to a program provided from the memory 312, and generate a control signal according to the result of the processing.

For example, the processor 311 may process an output of the storage room temperature sensor 320, and generate a cooling control signal for controlling the compressor 51 and the switching valve 53 of the cooling apparatus 50 in order to cool the storage room 20. The processor 311 may process an output of the ice making temperature sensor 330, and generate an ice making control signal for controlling the ice discharging motor 130 and the ice discharging heater 170 of the ice making apparatus 60. The processor 311 may process an output of the dispenser lever 41, and generate an ice discharge control signal for controlling the transfer motor 230 of the ice making apparatus 60 in order to discharge ice cubes.

Also, the processor 311 may generate an ice agglomeration preventing signal for controlling the transfer motor 230 of the ice making apparatus 60, in order to prevent ice cubes from agglomerating when the transfer motor 230 or the compressor 51 operates or when the door 30 opens.

As such, the controller 310 may control the components included in the refrigerator 1 according to temperature of the storage room 20, temperature of the ice making apparatus 60, and an operation of the ice making apparatus 60.

Also, operations of the refrigerator 1, which will be described below, may be performed according to the control of the controller 310.

Figure 12:
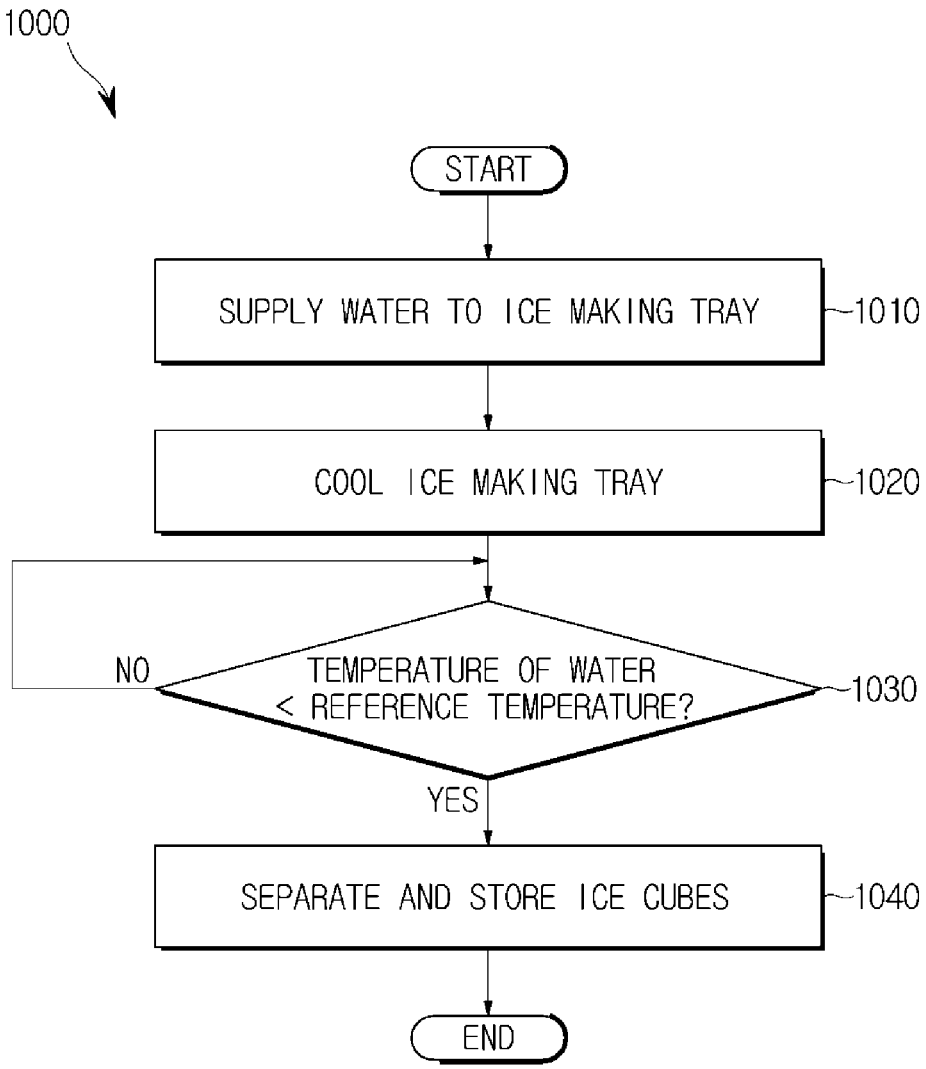
FIG. 12 is a flowchart illustrating an ice making operation of a refrigerator according to an embodiment.

FIG. 12 is a flowchart illustrating an ice making operation of a refrigerator according to an embodiment.

Hereinafter, an ice making operation 1000 of the refrigerator 1 will be described with reference to FIG. 12.

The refrigerator 1 may supply water to the ice making tray 110, in operation 1010.

The controller 310 of the refrigerator 1 may open a water supply valve (not shown) to supply water to the ice making tray 110. Water may be supplied to the plurality of ice making trays 110, sequentially.

The refrigerator 1 may cool the ice making tray 110, in operation 1020.

The controller 310 of the refrigerator 1 may operate the compressor 51 of the cooling apparatus 50 to make a flow of refrigerants, and control the switching valve 53 to supply the refrigerants to the ice making refrigerant pipe 59.

For example, the compressor 51 may compress refrigerants of a liquid state, and discharge the refrigerants. The refrigerants discharged from the compressor 51 may enter the switching valve 53 via the condenser 52. Then, the refrigerants may be guided to the ice making refrigerant pipe 59 via the expander 55 by the switching valve 53. The refrigerants may be vaporized when passing through the ice making refrigerant pipe 59, and when the refrigerants are vaporized, the ice making tray 110 (for example, the second ice making tray) may be cooled. Thereafter, the refrigerants may enter the compressor 51 via the evaporator 57 of the lower storage room 20*b*.

In this way, the refrigerants may be circulated by the compressor 51. Also, when the refrigerants are circulated, the refrigerants may absorb heat from the ice making tray 110, and cool the ice making tray 110.

When the ice making tray 110 is cooled, the refrigerator 1 may determine whether temperature of water or ice cubes contained in the ice making tray 110 is lower than reference temperature, in operation 1030.

When the ice making tray 110 is cooled, the water contained in the ice making tray 110 may also be cooled. For example, the second ice making tray 112 contacting the ice making refrigerant pipe 59 may be cooled by the ice making refrigerant pipe 59, and the first ice making tray 111 contacting the second ice making tray 112 may be cooled accordingly. Also, water stored in the ice making cells 110*a* of the first ice making tray 111 may be cooled and frozen.

The ice making temperature sensor 330 installed in the ice making tray 110 may measure temperature of water and/or ice cubes contained in the ice making tray 110. The controller 310 may determine freezing of the water contained in the ice making tray 110 based on an output from the ice making temperature sensor 330.

When water starts being frozen, the water may be maintained at temperature of about zero degrees Celsius, and when the water is completely frozen, temperature of ice may be lowered to below zero degrees Celsius. Also, if the temperature of the ice is sufficiently low (about 10 degrees to 20 degrees below zero Celsius), the ice will not melt easily despite a change in ambient temperature.

In order to determine whether water is completely frozen, the reference temperature may be set within 5 degrees to 20 degrees below zero Celsius.

If the temperature of the water or ice cubes contained in the ice making tray 110 is not lower than the reference temperature ("NO" in operation 1030), the refrigerator 1 may repeatedly measure temperature of the water or ice cubes contained in the ice making tray 110.

If the temperature of the water or ice cubes contained in the ice making tray 110 is lower than the reference temperature ("YES" in operation 1030), the refrigerator 1 may separate the ice cubes from the ice making tray 110, and store the ice cubes in the ice bucket 210, in operation 1040.

If the ice cubes are completely made, the controller 310 of the refrigerator 1 may separate the ice cubes from the ice making tray 110, and store the separated ice cubes in the ice bucket 210, in order to make new ice cubes.

The controller 310 may drive the ice discharging heater 170 in order to separate the ice cubes from the ice making tray 110. The ice discharging heater 170 may heat the ice making tray 110, and a part of the ice cubes contacting the ice making tray 110 may melt. As a result, a water screen may be formed between the ice cubes and the ice making tray 110, and accordingly, the ice cubes can move smoothly on the ice making tray 110.

Thereafter, the controller 310 may control the ice discharging motor 130 to cause the scooping blade 122 of the ice discharging portion 120 to push the ice cubes out of the ice making tray 110. The ice discharging motor 130 may rotate the ice discharging portion 120 to cause the scooping blade 122 to push the ice cubes out of the ice making tray 110.

As described above, the refrigerator 1 may make ice cubes using the ice maker 100, and store the ice cubes in the ice storage 200.

Also, the refrigerator 1 may discharge the ice cubes stored in the ice storage 200 to the outside in response to a user's discharge instruction input through the dispenser lever 41.

If the dispenser lever 41 is pressed by the user, the controller 310 may control the transfer motor 230 so that the transfer member 220 transfers the ice cubes toward the outlet 211 of the ice bucket 210. For example, the controller 310 may control the transfer motor 230 such that the transfer member 220 rotates in the second rotation direction (the counterclockwise direction of FIGS. 8, 9, and 10). In other words, the controller 310 may rotate the transfer motor 230 in the second rotation direction.

When the transfer member 220 rotates in the second rotation direction, the ice cubes may be transferred toward the outlet 211, and then discharged through the dispenser 40.

As described above, the refrigerator 1 may discharge ice cubes stored in the ice storage 200 to the outside in response to the user's discharge instruction.

As described above, if ice cubes are stored for a long time in the ice storage room 210*a*, the ice cubes stored in the ice storage room 210*a* may be stuck or agglomerate together due to various causes.

The refrigerator 1 may perform an operation for preventing ice cubes stored in the ice storage room 210*a* from agglomerating together.

Hereinafter, an operation for preventing ice cubes stored in the ice storage room 210*a* from agglomerating will be described.

Figure 13:
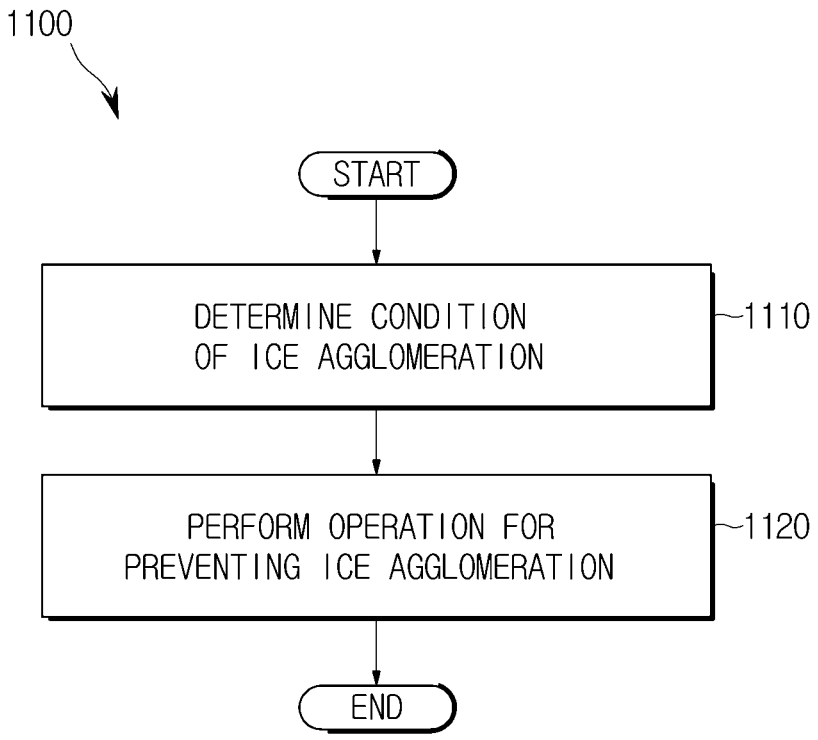
FIG. 13 is a flowchart illustrating an example of an ice agglomeration preventing operation of a refrigerator according to an embodiment.

FIG. 13 is a flowchart illustrating an example of an ice agglomeration preventing operation of a refrigerator according to an embodiment.

Hereinafter, an ice agglomeration preventing operation 1100 of the refrigerator 1 will be described with reference to FIG. 13.

The refrigerator 1 may determine a condition of ice agglomeration, in operation 1110.

If ice cubes are stored in the ice bucket 210 for a long time, the ice cubes stored in the ice bucket 210 may be stuck or agglomerate together due to various causes.

The agglomerated ice cubes may be not transferred by the transfer member 220. In other words, the agglomerated ice cubes may be not discharged to the outside by the transfer member 220.

In order to prevent ice cubes from being not discharged to the outside, the refrigerator 1 may prevent ice agglomeration. In order to prevent ice cubes from agglomerating, the controller 310 of the refrigerator 1 may determine a condition under which ice cubes stored in the ice bucket 210 agglomerate. For example, the controller 310 may determine a condition under which ice cubes agglomerate easily, based on an operation of the transfer motor 230, an operation of the dispenser 40, an operation of the compressor 51, an operation of the ice storage fan 250, the number of times the door 300 opens, a defrosting operation of the ice making refrigerant pipe 59, etc.

If the refrigerator 1 determines that the condition of ice agglomeration is satisfied, the refrigerator 1 may perform an operation for preventing ice agglomeration, in operation 1120.

If the condition of ice agglomeration is satisfied, the ice cubes stored in the ice bucket 210 may be predicted to agglomerate.

Accordingly, if the refrigerator 1 determines that the condition of ice agglomeration is satisfied, the refrigerator 1 may perform an operation for preventing the ice cubes stored in the ice bucket 210 from agglomerating or for delaying agglomeration of the ice cubes.

For example, the refrigerator 1 may apply a physical force to the ice cubes to prevent the ice cubes from agglomerating.

The controller 310 of the refrigerator 1 may rotate the transfer member 220 in the first rotation direction and/or in the second rotation direction to prevent the ice cubes from agglomerating. In other words, the controller 310 may operate the transfer motor 230 to rotate the transfer member 220 in the first rotation direction and/or in the second rotation direction.

When the transfer member 220 rotates, the ice cubes stored in the ice bucket 210 may move separately, and accordingly, the sticking of the ice cubes may be broken. As a result, it is possible to prevent the ice cubes stored in the ice bucket 210 from agglomerating.

Figure 14:
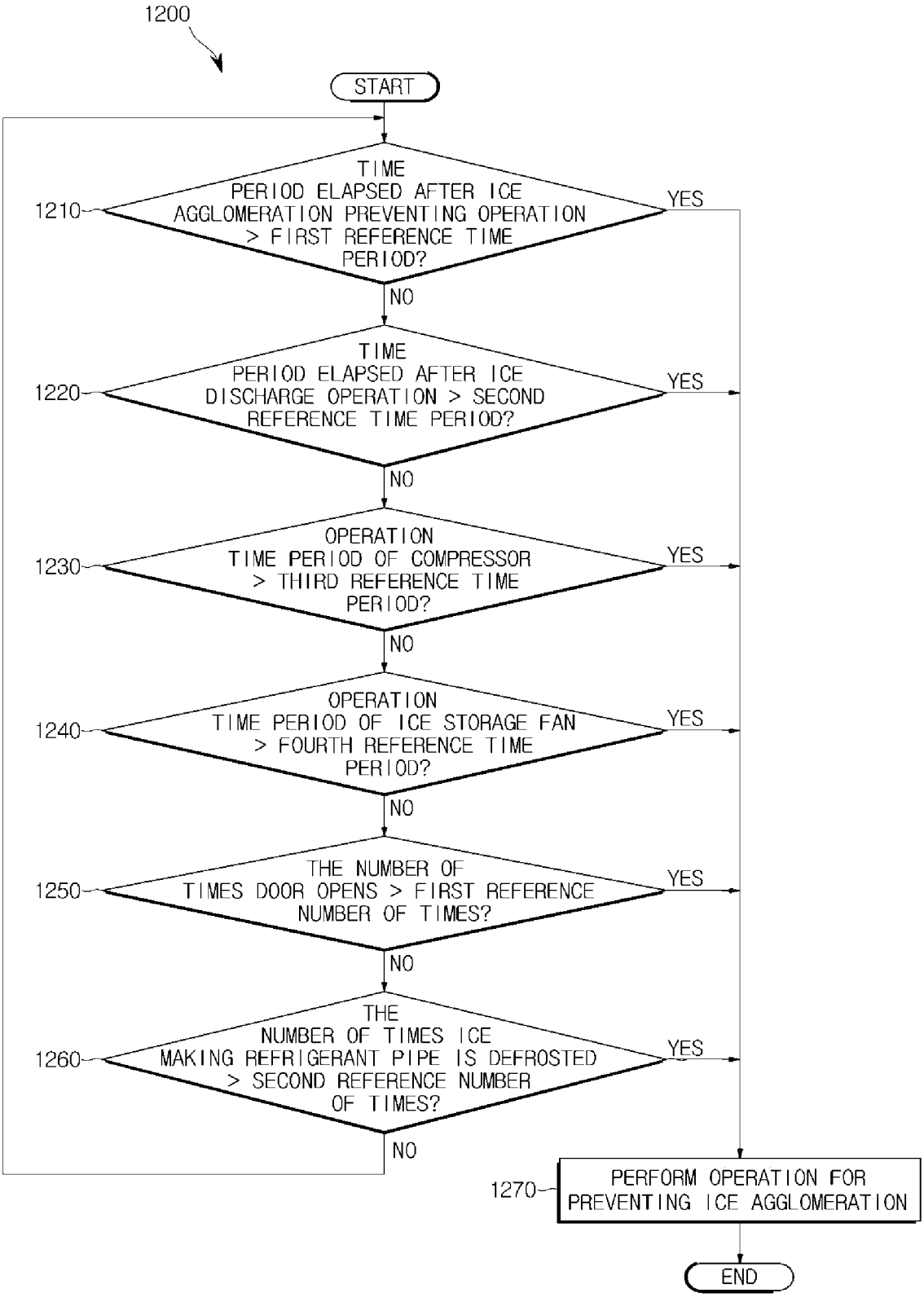
FIG. 14 is a flowchart illustrating another example of an ice agglomeration preventing operation of a refrigerator according to an embodiment.

FIG. 14 is a flowchart illustrating another example of an ice agglomeration preventing operation of a refrigerator according to an embodiment.

Hereinafter, an ice agglomeration preventing operation 1200 of the refrigerator 1 will be described with reference to FIG. 14.

The refrigerator 1 may determine whether a time period elapsed after an ice agglomeration preventing operation is longer than a first reference time period, in operation 1210.

As described above with reference to FIG. 13, the refrigerator 1 may perform an ice agglomeration preventing operation for preventing ice agglomeration. For example, the controller 310 of the refrigerator 1 may operate the transfer motor 230 such that the transfer member 220 rotates in the first rotation direction and/or in the second rotation direction. When the transfer member 220 rotates, ice cubes stored in the ice bucket 210 may move, and accordingly, the sticking of the ice cubes may be broken.

Although the operation for preventing ice agglomeration is performed, the ice cubes stored in the ice bucket 210 may be again stuck together over time to agglomerate together.

Accordingly, the refrigerator 1 may determine whether the first reference time period has elapsed after the ice agglomeration preventing operation is performed, in order to determine whether the ice cubes stored in the ice bucket 210 are again stuck together. For example, the controller 310 of the refrigerator 1 may determine whether the first reference time period has elapsed after the transfer motor 230 operated.

The first reference time period may be a time period taken for ice cubes to be stuck together by sublimation of ice, and may be set within about 12 hours to about 72 hours.

If the time period elapsed after the ice agglomeration preventing operation is longer than the first reference time period ("YES" in operation 1210), the refrigerator 1 may perform an operation for preventing ice agglomeration, in operation 1270.

That is, when the first reference time period has elapsed after the ice agglomeration preventing operation was performed, the refrigerator 1 may again perform an ice agglomeration preventing operation. More specifically, when the first reference time period has elapsed after the transfer motor operated in order to prevent ice agglomeration, the controller 310 may operate the transfer motor 230 such that the transfer member 220 rotates in the first rotation direction and/or in the second rotation direction.

If the time period elapsed after the ice agglomeration preventing operation is not longer than the first reference time period ("NO" in operation 1210), the refrigerator 1 may determine whether a time period elapsed after an ice discharge operation is longer than a second reference time period, in operation 1220.

The refrigerator 1 may discharge ice cubes stored in the ice bucket 210 in response to a user's ice discharge instruction input through the dispenser lever 41.

For example, the controller 310 of the refrigerator 1 may operate the transfer motor 230 such that the transfer member 220 rotates in the second rotation direction. When the transfer member 220 rotates, the ice cubes stored in the ice bucket 210 may move toward the outlet 211, and be discharged through the dispenser 40.

Also, when the transfer member 220 rotates, the sticking of the ice cubes stored in the ice bucket 210 may be broken, and accordingly, ice agglomeration can be prevented.

However, although ice agglomeration is prevented when ice cubes are discharged, ice cubes stored in the ice bucket 210 may be again stuck together over time to agglomerate.

Accordingly, the refrigerator 1 may determine whether the second reference time period has elapsed after the dispenser lever 41 was pressed, in order to determine whether the ice cubes stored in the ice bucket 210 are again stuck together. For example, the controller 310 of the refrigerator 1 may determine whether the second reference time period has elapsed after the dispenser lever 41 was pressed.

The second reference time period may be a time period taken for ice cubes to be stuck together by sublimation of ice, etc., and may be set within about 12 hours to about 72 hours.

If the time period elapsed after the ice discharge operation is longer than the second reference time period ("YES" in operation 1220), the refrigerator 1 may perform an operation for preventing ice agglomeration, in operation 1270.

That is, when the second time period has elapsed after the ice discharge operation was performed, the refrigerator 1 may perform an ice agglomeration preventing operation. More specifically, when the second reference time period has elapsed after the dispenser lever 41 for discharging ice cubes was pressed, the controller 310 may operate the transfer motor 230 such that the transfer member 220 rotates in the first rotation direction and/or in the second rotation direction.

If the time period elapsed after the ice discharge operation is not longer than the second reference time period ("NO" in operation 1220), the refrigerator 1 may determine whether an operation time period of the compressor 51 is longer than a third reference time period, in operation 1230.

Ice agglomeration may accelerate when the compressor 51 operates. When the compressor 51 operates, and refrigerants are supplied to the ice making refrigerant pipe 59, inside temperature of the ice storage 200 may be further lowered. As a result, sublimation of water vapor in the inside of the ice storage 200 may accelerate, and also, agglomeration of ice cubes stored in the ice bucket 210 may accelerate accordingly.

The refrigerator 1 may determine whether a time period for which the compressor 51 operates after the ice agglomeration preventing operation or the ice discharge operation is longer than the third reference time period, in order to determine whether agglomeration of ice cubes stored in the ice bucket 210 accelerates. For example, the controller 310 may measure a time period for which the compressor 51 operates after the transfer motor 230 operates for an ice agglomeration preventing operation or an ice discharge operation, and compare the operation time period of the compressor 51 to the third reference time period.

The third reference time period may be a time period for which agglomeration of ice cubes accelerates by sublimation of ice, etc., and may be set within about 3 hours to about 6 hours.

If the operation time period of the compressor 51 is longer than the third reference time period ("YES" in operation 1230), the refrigerator 1 may perform an operation for preventing ice agglomeration, in operation 1270.

That is, if the time period for which the compressor 51 operates after the ice agglomeration preventing operation or the ice discharge operation is longer than the third reference time period, the refrigerator 1 may perform an ice agglomeration preventing operation.

More specifically, the controller 310 may operate the transfer motor 230 such that the transfer member 220 rotates in the first rotation direction and/or in the second rotation direction.

If the time period for which the compressor 51 operates is not longer than the third reference time period ("NO" in operation 1230), the refrigerator 1 may determine whether an operation time period of the ice storage fan 250 is longer than a fourth reference time period, in operation 1240.

The ice storage fan 250 may circulate cool air in the cool air duct 125 to the ice bucket 210. The ice storage fan 250 may operate when the compressor 51 operates. Also, the ice storage fan 250 may stop when the compressor 51 stops, or when a predetermined time period has elapsed after the compressor 51 stopped. As such, operating or stopping the ice storage fan 250 may be synchronized with operating or stopping the compressor 51.

Also, when the compressor 51 operates and the ice storage fan 250 operates, ice agglomeration may accelerate. More specifically, when the compressor 51 operates and the ice storage fan 250 operates, sublimation of water vapor in the ice storage 200 may accelerate, and also, agglomeration of ice cubes stored in the ice bucket 210 may accelerate accordingly.

The refrigerator 1 may determine whether a time period for which the ice storage fan 250 operates after an ice agglomeration preventing operation or an ice discharge operation is longer than a fourth reference time period, in order to determine whether agglomeration of the ice cubes stored in the ice bucket 210 accelerates. For example, the controller 310 may measure an operation time period of the ice storage fan 250 after the transfer motor 230 operates for an ice agglomeration preventing operation or an ice discharge operation, and compare the operation time period of the ice storage fan 250 to the fourth reference time period.

The fourth reference time period may be a time period for which agglomeration of ice cubes accelerates by sublimation of ice, etc., and may be set within about 3 hours to about 6 hours.

If the controller 310 determines that the operation time period of the ice storage fan 250 is longer than the fourth reference time period ("YES" in operation 1240), the refrigerator 1 may perform an operation for preventing ice agglomeration, in operation 1270.

That is, if the operation time period for which the ice storage fan 250 operates after an ice agglomeration preventing operation or an ice discharge operation is longer than the fourth reference time period, the refrigerator 1 may perform an ice agglomeration preventing operation. More specifically, the controller 310 may operate the transfer motor 230 such that the transfer member 220 rotates in the first rotation direction and/or in the second rotation direction.

If the operation time period of the ice storage fan 250 is not longer than the fourth reference time period ("NO" in operation 1240), the refrigerator 1 may determine whether the number of times the door 30 opens is greater than a first reference number of times, in operation 1250.

If the door 30 often opens, ice agglomeration may accelerate.

For example, if the door 30 often opens, temperature of the storage room 20 may rise. If the temperature of the storage room 20 rises, an operation time period of the compressor 51 may increase. If the operation time period of the compressor 51 increases, sublimation of water vapor in the ice bucket 210 may accelerate, and accordingly, ice agglomeration may accelerate.

According to another example, when the door 30 opens, an amount of water vapor entering the storage room 20 or the ice making apparatus 60 from the outside may increase. If the amount of water vapor entering the ice making apparatus 60 increases, sublimation of water vapor in the ice bucket 210 may accelerate, and accordingly, ice agglomeration may accelerate.

As such, if the door 30, more specifically, the doors 30*aa* as 30*ab* of the storage room 20 in which the ice making apparatus 60 is installed often open, ice agglomeration may accelerate. As shown in FIGS. 1 and 2, if the first upper door 30*aa* and the second upper door 30*ab* opening or closing the upper storage room 20*a* often open, ice agglomeration may accelerate.

The refrigerator 1 may determine whether the number of times the door 30 opens after an ice agglomeration preventing operation or an ice discharge operation is greater than the first reference number of times, in order to determine whether agglomeration of the ice cubes stored in the ice bucket 210 accelerates. For example, the controller 310 may count the number of times the door 30 opens, and compare the number of times the door 30 opens to the first reference number of times.

Also, the refrigerator 1 may count the number of times per hour the door 30 opens, in order to obtain frequency of opening of the door 30. Also, the refrigerator 1 may compare the number of times per hour the door 30 opens to a reference number of times.

If the number of times the door 30 opens is greater than the first reference number of times ("YES" in operation 1250), the refrigerator 1 may perform an operation for preventing ice agglomeration, in operation 1270.

If the number of times the doors 30*aa* and 30*ab* of the upper storage room 20*a* in which the ice making apparatus 60 is installed open after an ice agglomeration preventing operation or an ice discharge operation is greater than the first reference number of times, the refrigerator 1 may perform an ice agglomeration preventing operation. More specifically, the controller 310 may operate the transfer motor 230 such that the transfer member 220 rotates in the first rotation direction and/or in the second rotation direction.

If the number of times the door 30 opens is not greater than the first reference number of times ("NO" in operation 1250), the refrigerator 1 may determine whether the number of times the ice making refrigerant pipe 59 is defrosted is greater than a second reference number of times, in operation 1260.

The refrigerator 1 may defrost the ice making refrigerator pipe 59 using the ice discharging heater 170. More specifically, the refrigerator 1 may operate the ice discharging heater 170 to remove frost formed on the surface of the ice making refrigerant pipe 59. The ice discharging heater 170 may heat the surface of the ice making refrigerant pipe 59 to remove frost.

While the ice discharging heater 170 operates in order to defrost the ice making refrigerant pipe 59, air in the ice bucket 210 may be heated together, and accordingly, inside temperature of the ice bucket 210 may rise. As a result, the surfaces of some of the ice cubes stored in the ice bucket 210 may melt. When the ice cubes whose surfaces melt are again frozen, the ice cubes may be stuck together to agglomerate.

As such, when the ice making refrigerant pipe 59 is defrosted, agglomeration of the ice cubes stored in the ice bucket 210 may accelerate.

The refrigerator 1 may determine whether the number of times the ice making refrigerant pipe 59 is defrosted after an ice agglomeration preventing operation or an ice discharge operation is greater than a second reference number of times, in order to determine whether agglomeration of the ice cubes stored in the ice bucket 210 accelerates. For example, the controller 310 may count the number of times of defrosting of the ice making refrigerant pipe 59, and compare the number of times of defrosting of the ice making refrigerant pipe 59 to the second reference number of times.

If the number of times of defrosting of the ice making refrigerant pipe 59 is greater than the second reference number of times ("YES" in operation 1260), the refrigerator 1 may perform an operation for preventing ice agglomeration, in operation 1270.

If the number of times the ice making refrigerant pipe 59 is defrosted after an ice agglomeration preventing operation or an ice discharge operation is greater than the second reference number of times, the refrigerator 1 may perform an ice agglomeration preventing operation. More specifically, the controller 310 may operate the transfer motor 230 such that the transfer member 220 rotates in the first rotation direction and/or in the second rotation direction.

If the number of times the ice making refrigerant pipe 59 is defrosted is not greater than the second reference number of times ("NO" in operation 1260), the refrigerator 1 may determine whether a time period elapsed after an ice agglomeration preventing operation is longer than the first reference time period, in operation 1210.

In other words, the refrigerator 1 may perform the operation 1210, the operation 1220, the operation 1230, the operation 1240, the operation 1250, and the operation 1260.

As described above, the refrigerator 1 may determine whether a condition for preventing ice agglomeration is satisfied. For example, the refrigerator 1 may determine a condition under which ice cubes agglomerate easily, based on an operation of the transfer motor 230, an operation of the dispenser 40, an operation of the compressor 51, an operation of the ice storage fan 250, the number of time the door 30 opens, a defrosting operation of the ice making refrigerant pipe 59, etc.

If the refrigerator 1 determines that the condition for preventing ice agglomeration is satisfied, the refrigerator 1 may perform an operation for preventing ice agglomeration. Also, by performing the operation for preventing ice agglomeration, ice agglomeration may be prevented, or ice agglomeration may be at the least delayed.

In regard of conditions for preventing ice agglomeration, the operation 1210, the operation 1220, the operation 1230, the operation 1240, the operation 1250, and the operation 1260 have been described above. However, conditions for preventing ice agglomeration are not limited to the above-described conditions.

The refrigerator 1 may perform one or more operations among the operation 1210, the operation 1220, the operation 1230, the operation 1240, the operation 1250, and the operation 1260. For example, the refrigerator 1 may perform only the operation 1210 or the operation 1220. Also, the refrigerator 1 may perform only the operations 1210 and 1230, or only the operations 1210, 1230, and 1260.

Figure 15:
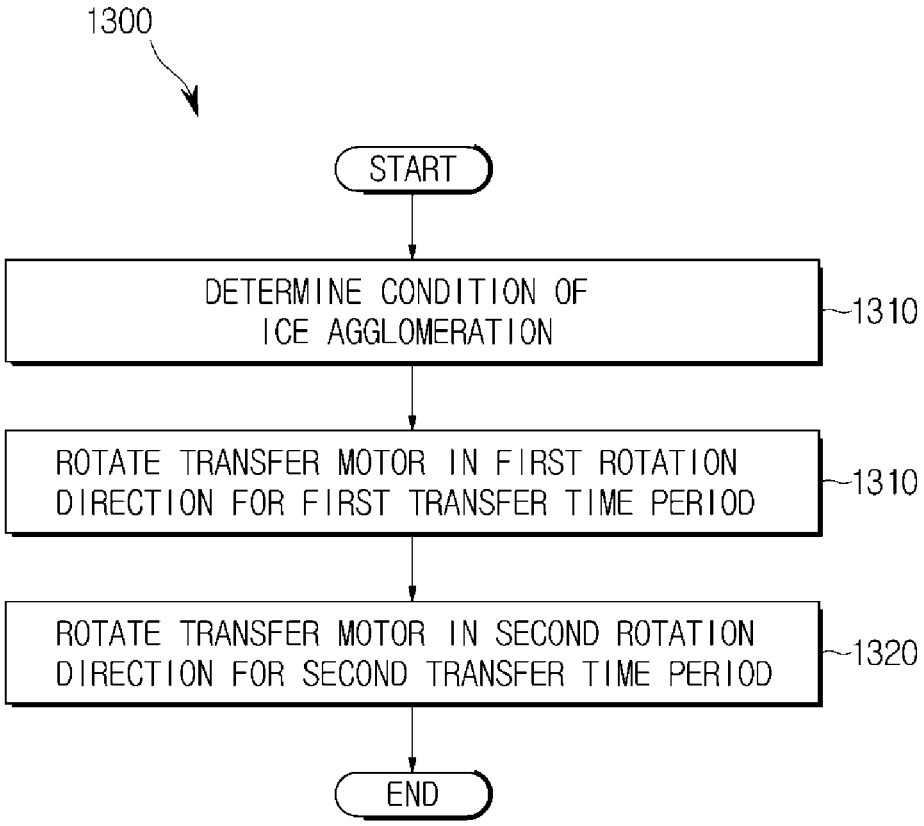
FIG. 15 is a flowchart illustrating another example of an ice agglomeration preventing operation of a refrigerator according to an embodiment.
Figure 16:
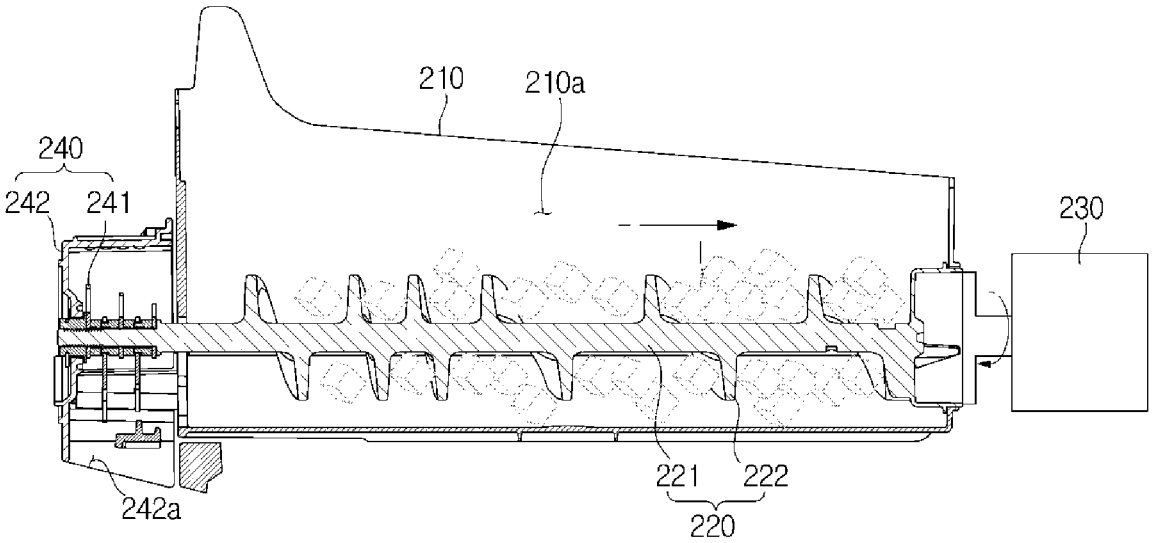
FIGS. 16 and 17 are views illustrating an example in which a refrigerator according to an embodiment prevents ice agglomeration.
Figure 17:
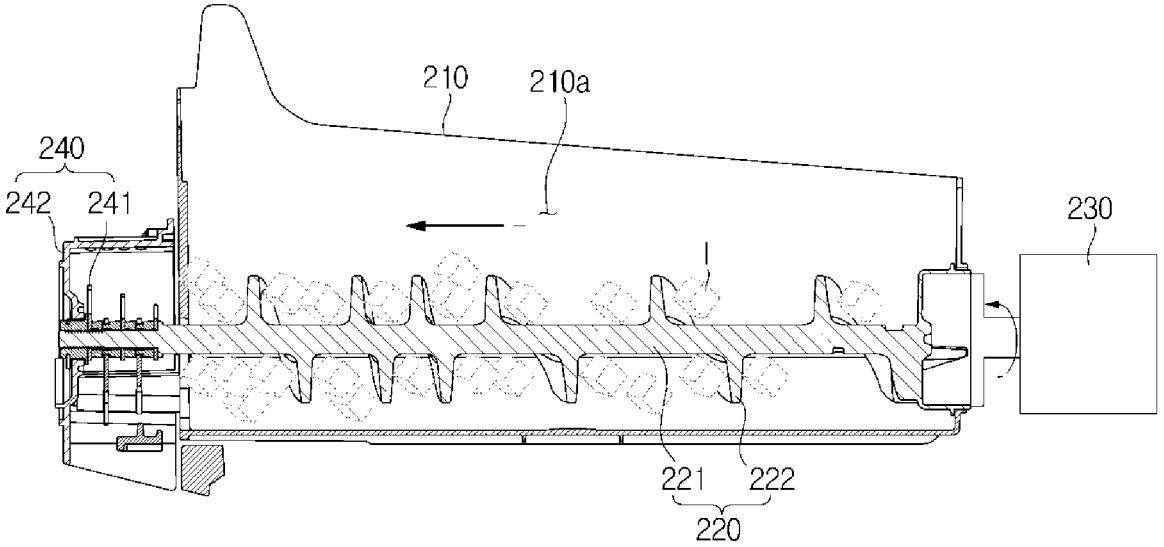

FIG. 15 is a flowchart illustrating another example of an ice agglomeration preventing operation of a refrigerator according to an embodiment. FIGS. 16 and 17 are views illustrating an example in which a refrigerator according to an embodiment prevents ice agglomeration.

The refrigerator 1 may determine a condition of ice agglomeration, in operation 1310.

In order to prevent ice agglomeration, the controller 310 of the refrigerator 1 may determine a condition in which ice cubes stored in the ice bucket 210 agglomerate. For example, as described above with reference to FIG. 14, the controller 310 may determine a condition in which ice cubes agglomerate, based on an operation of the transfer motor 230, an operation of the dispenser 40, an operation of the compressor 51, an operation of the ice storage fan 250, the number of times the door 30 opens, a defrosting operation of the ice making refrigerant pipe 59, etc.

If the refrigerator 1 determines that a condition of ice agglomeration is satisfied, the refrigerator 1 may rotate the transfer motor 230 in the first rotation direction for a first transfer time period, in operation 1320.

If the condition in which ice cubes agglomerate easily is satisfied, ice cubes I stored in the ice bucket 210 may be predicted to agglomerate together, or ice agglomeration may be predicted to accelerate.

Accordingly, the refrigerator 1 may rotate the transfer motor 230 of the ice storage 200 in the first rotation direction for the first transfer time period, in order to prevent the ice cubes I stored in the ice bucket 210 from agglomerating.

When the transfer motor 230 rotates, the transfer member 220 connected to the transfer motor 230 may rotate in the first rotation direction. Also, when the transfer member 220 rotates in the first rotation direction, the transfer blade 222 may push the ice cubes I stored in the ice bucket 210 in the opposite direction from the outlet 211.

As a result, when the transfer member 220 rotates in the first rotation direction, the ice cubes I stored in the ice bucket 210 may be transferred toward the opposite direction from the outlet 211 of the ice bucket 210, as shown in FIG. 16.

When the ice cubes I are transferred by the transfer member 220, an external force may be applied to the ice cubes I, and the sticking of the ice cubes I may be broken. In other words, when the ice cubes I are transferred by the transfer member 220, the ice cubes I stored in the ice bucket 210 may be separated. Accordingly, when the ice cubes I are transferred, ice agglomeration may be reduced, or agglomerated ice cubes may be separated.

Also, when the ice cubes I stored in the ice bucket 210 are transferred toward the opposite direction from the outlet 211 of the ice bucket 210, the ice cubes I may be prevented from being discharged through the outlet 211.

Thereafter, the refrigerator 1 may rotate the transfer motor 230 in the second rotation direction for a second transfer time period, in operation 1330.

When the second transfer time period has elapsed after rotating the transfer motor 230 in the first rotation direction, the refrigerator 1 may rotate the transfer motor 230 of the ice storage 200 in the second rotation direction for the second transfer time period.

When the transfer motor 230 rotates, the transfer member 220 connected to the transfer motor 230 may rotate in the second rotation direction. When the transfer member 220 rotates in the second rotation direction, the transfer blade 222 may push the ice cubes I stored in the ice bucket 210 toward the outlet 211.

As a result, when the transfer member 220 rotates in the second rotation direction, the ice cubes I stored in the ice bucket 210 may be transferred toward the outlet 211 of the ice bucket 210, as shown in FIG. 17.

As described above, when the transfer member 220 rotates in the first rotation direction, the ice cubes I may be transferred toward the opposite direction from the outlet 211 of the ice bucket 210. As a result, the density of the ice cubes I may increase in the opposite side from the outlet 211. Accordingly, as the density of the ice cubes I increases, ice agglomeration may accelerate.

In order to prevent such ice agglomeration, the refrigerator 1 may transfer the ice cubes I toward the outlet 211 after transferring the ice cubes I toward the opposite direction from the outlet 211.

If the ice cubes I are transferred toward the opposite direction from the outlet 211 and then transferred toward the outlet 211, the ice cubes I may be distributed relatively uniformly in the ice bucket 210, as shown in FIG. 17.

Also, the second transfer time period for which the refrigerator 1 transfers the ice cubes I toward the outlet 211 may be equal to or shorter than the first transfer time period for which the refrigerator 1 transfers the ice cubes I toward the opposite direction from the outlet 211. As a result, the ice cubes I may be prevented from being discharged through the outlet 211 of the ice bucket 210.

When the ice cubes I are transferred by the transfer member 220, an external force may be applied to the ice cubes I, and thus the ice cubes I may be separated by the external force. Accordingly, when the ice cubes I are transferred, ice agglomeration may be reduced, or agglomerated ice cubes may be separated.

As described above, the refrigerator 1 may move the ice cubes I stored in the ice bucket 210 in order to prevent ice agglomeration. More specifically, the refrigerator 1 may transfer the ice cubes I toward the opposite direction from the outlet 211 of the ice bucket 210, and then transfer the ice cubes I toward the outlet 211.

As a result, the sticking of the ice cubes I may be broken. Further, the ice cubes I can be distributed relatively uniformly in the ice bucket 210, and accordingly, ice agglomeration can be further delayed.

Figure 18:
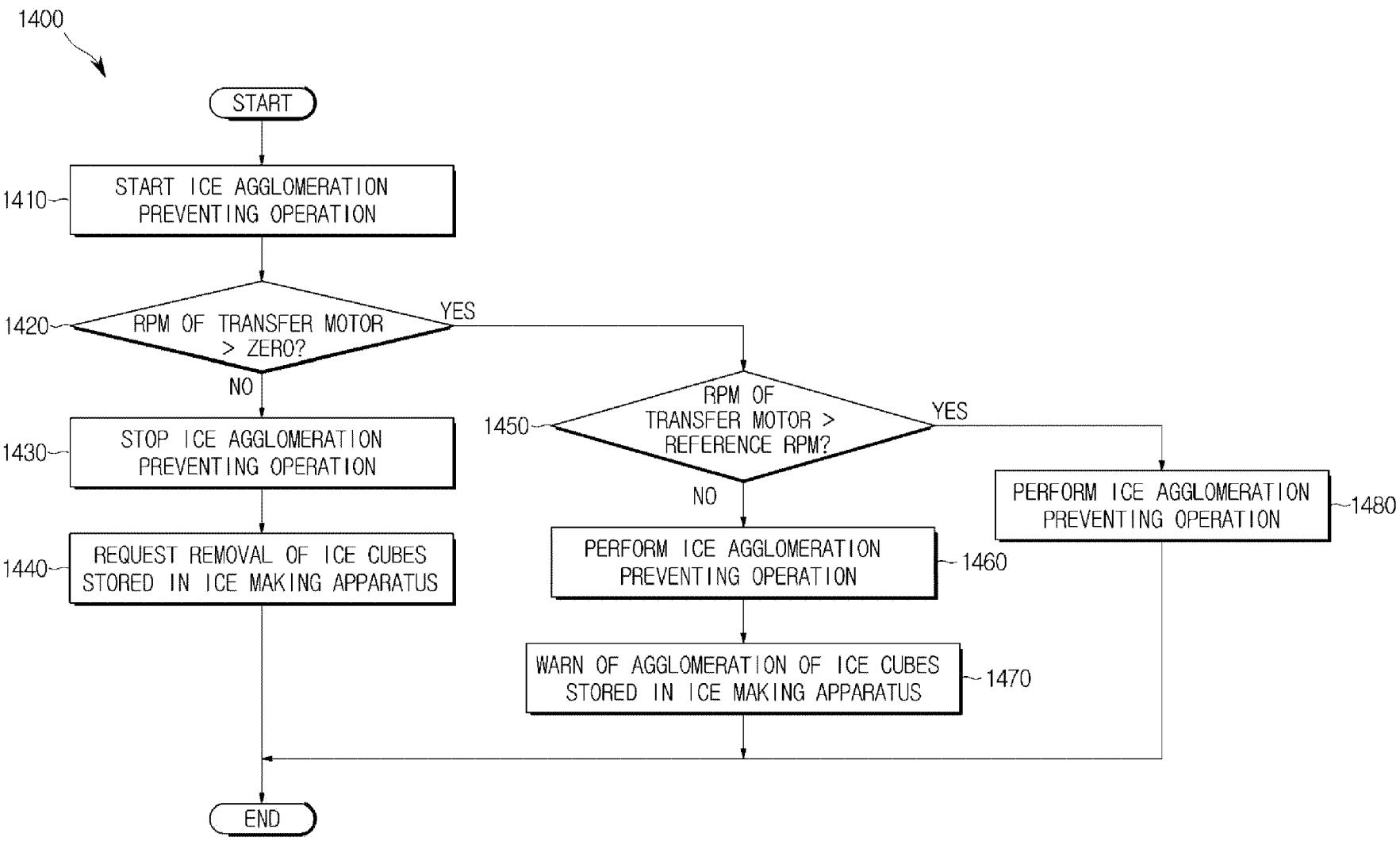
FIG. 18 is a flowchart illustrating an example of an ice agglomeration warning operation of a refrigerator according to an embodiment.
Figure 19:
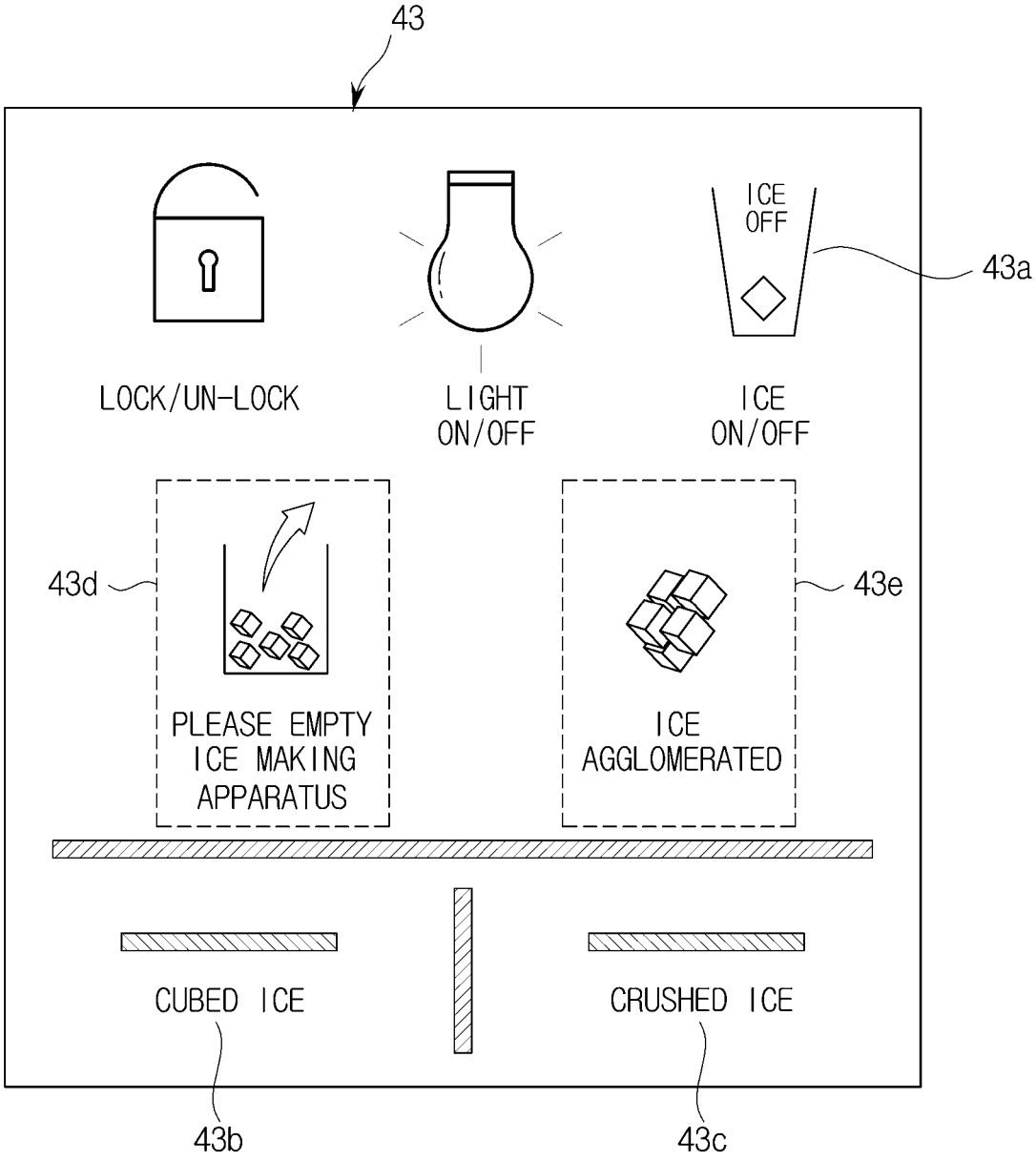
FIGS. 19 and 20 are views illustrating an example in which a refrigerator according to an embodiment warns of ice agglomeration.
Figure 20:
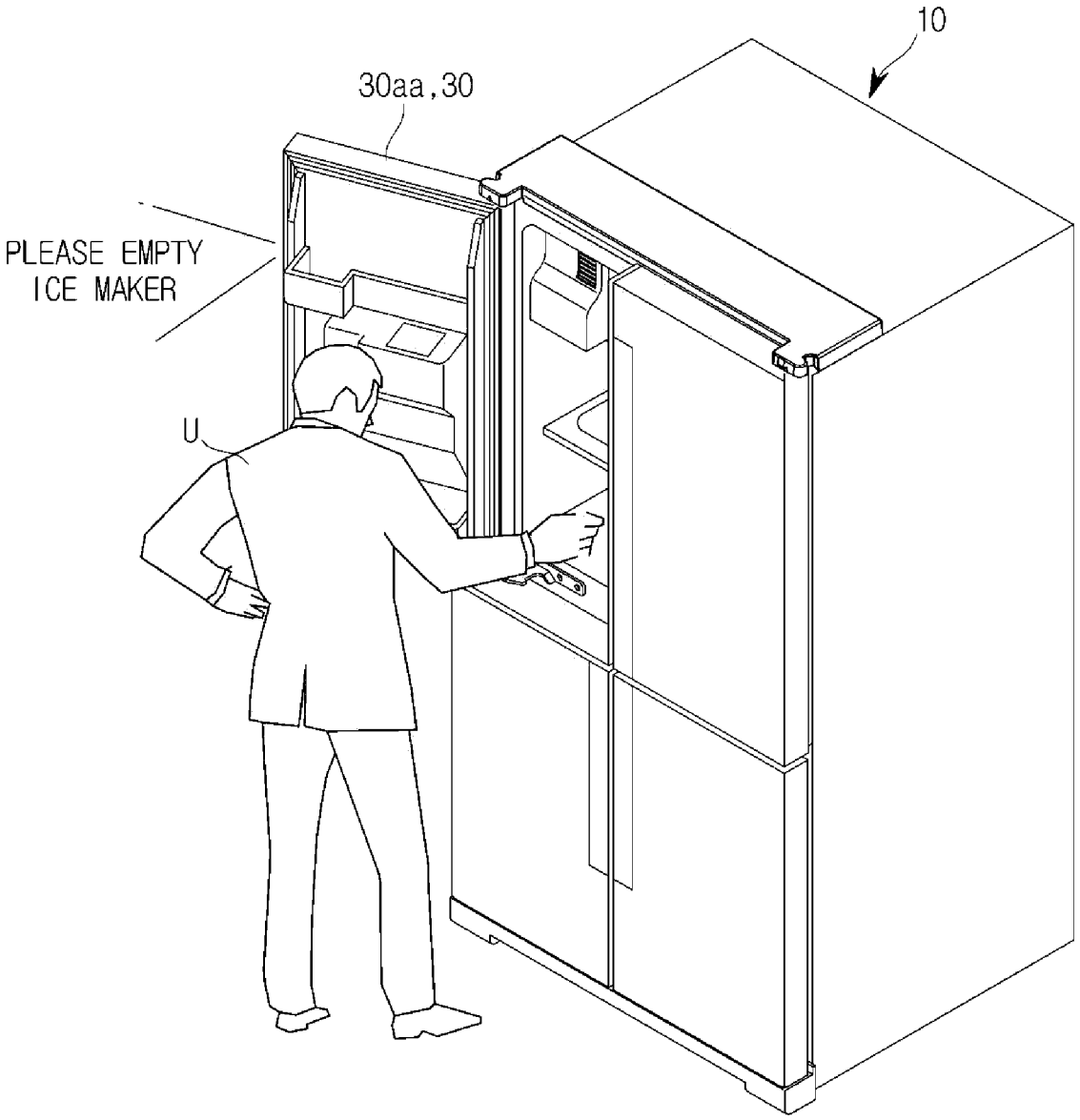

FIG. 18 is a flowchart illustrating an example of an ice agglomeration warning operation of a refrigerator according to an embodiment. FIGS. 19 and 20 are views illustrating an example in which a refrigerator according to an embodiment warns of ice agglomeration.

As described above, if ice agglomeration is predicted, the refrigerator 1 may perform an ice agglomeration preventing operation. The ice agglomeration preventing operation may include rotating the transfer member 220 in the first rotation direction or the second rotation direction through the transfer motor 230.

During the ice agglomeration preventing operation, the refrigerator 1 may determine whether ice agglomeration occurs, and warn a user of ice agglomeration.

Hereinafter, an ice agglomeration warning operation 1400 of the refrigerator 1 will be described with reference to FIGS. 18, 19, and 20.

The refrigerator 1 may start an ice agglomeration preventing operation, in operation 1410.

The refrigerator 1 may determine whether a condition of ice agglomeration is satisfied. For example, the controller 310 may determine a condition under which ice cubes agglomerate easily, based on an operation of the transfer motor 230, an operation of the dispenser 40, an operation of the compressor 51, an operation of the ice storage fan 250, the number of time the door 30 opens, a defrosting operation of the ice making refrigerant pipe 59, etc.

If the refrigerator 1 determines that a condition of ice agglomeration is satisfied, the refrigerator 1 may perform an operation for preventing ice agglomeration. For example, the controller 310 may control the transfer motor 230 to rotate in the first rotation direction, and then control the transfer motor 230 to rotate in the second rotation direction.

During the ice agglomeration preventing operation, the refrigerator 1 may determine whether the rpm of the transfer motor 230 is greater than zero, in operation 1420.

The transfer motor 230 may rotate in the first rotation direction or in the second rotation direction in response to a control signal from the controller 310. Also, the transfer motor 230 may output information about a rotation while rotating. For example, the transfer motor 230 may output information about rpm.

The controller 310 may determine rpm of the transfer motor 230 based on the information about the rpm output from the transfer motor 230. Also, the controller 310 may determine whether the rpm of the transfer motor 230 is greater than zero. In other words, the controller 310 may determine whether the transfer motor 230 rotates.

Ice cubes agglomerated hard may interfere with a rotation of the transfer member 220. For example, when ice cubes agglomerated hard are stuck between the transfer blade 222 of the transfer member 220 and the inner wall of the ice bucket 210, the transfer member 220 cannot rotate.

Since a rotation of the transfer member 220 is interfered, the transfer motor 230 may also not rotate. Also, the transfer motor 230 may output information representing 0 rpm to the controller 310.

The controller 310 may determine a degree of ice agglomeration based on the rpm of the transfer motor 230. In other words, the controller 310 may determine whether ice cubes have agglomerated hard, based on the rpm of the transfer motor 230.

If the rpm of the transfer motor 230 is not greater than zero ("NO" in operation 1420), the refrigerator 1 may stop the ice agglomeration preventing operation, in operation 1430.

If the rpm of the transfer motor 230 is not greater than zero, the refrigerator 1 may determine that ice cubes have agglomerated hard. Also, since the ice cubes have already agglomerated hard, it may be determined that the ice agglomeration preventing operation is ineffective.

For this reason, the controller 310 may stop the ice agglomeration preventing operation. In other words, the controller 310 may control the transfer motor 230 to stop rotating.

Thereafter, the refrigerator 1 may request the user to remove the ice cubes stored in the ice making apparatus 60, in operation 1440.

Since the ice cubes have already agglomerated hard, the transfer member 220 cannot separate the agglomerated ice cubes by rotating, and also cannot transfer the agglomerated ice cubes by rotating.

Since the ice making apparatus 60 cannot separate or discharge the agglomerated ice cubes, the refrigerator 1 may request the user to remove the ice cubes stored in the ice making apparatus 60.

The refrigerator 1 may request the user to remove the ice cubes using various methods.

For example, the refrigerator 1 may request the user to remove the ice cubes through the dispenser display panel 43.

The dispenser display panel 43 may display operation states of the dispenser 40 and the ice making apparatus 60. For example, a screen of the dispenser display panel 43 may include an ice making activation display image 43*a* representing activation/deactivation of the ice making apparatus 60, a cubed ice display image 43*b* representing discharge of cubed ice, and a crushed ice display image 43*c* representing discharge of crushed ice. Also, the screen of the dispenser display panel 43 may further include an ice removal request image 43*d* for requesting the user to remove ice cubes, and an ice agglomeration warning image 43*e* for warning the user of ice agglomeration.

The controller 310 may control the dispenser display panel 43 to display the ice removal request image 43*d*.

The user may see the ice removal request image 43*d* displayed on the dispenser display panel 43 to recognize agglomeration of ice cubes stored in the ice making apparatus 60.

According to another example, the refrigerator 1 may request the user to remove ice cubes through the speaker 340. The speaker 340 may output sound corresponding to an electrical sound signal output from the controller 310.

More specifically, the controller 310 may control the speaker 340 to output a sound message for requesting the user to remove ice cubes stored in the ice making apparatus 60.

More specifically, when the door 30 opens, the controller 310 may control the speaker 340 to output a sound message for requesting the user to remove ice cubes stored in the ice making apparatus 60, as shown in FIG. 20.

The purpose of the sound message may cause the user to recognize agglomeration of the ice cubes stored in the ice making apparatus 60. Therefore, if the refrigerator 1 outputs the sound message when the user is distant from the refrigerator 1, the purpose of the sound message may not be achieved. In other words, the user cannot recognize agglomeration of the ice cubes stored in the ice making apparatus 60.

For this reason, when the user opens the door 30 of the refrigerator 1 (that is, when the user is located near the refrigerator 1), the controller 310 may control the speaker 340 to output the sound message for requesting the user to remove the ice cubes stored in the ice making apparatus 60.

The user may hear the sound message output from the speaker 340 to recognize agglomeration of the ice cubes stored in the ice making apparatus 60.

If the rpm of the transfer motor 230 is greater than zero ("YES" in operation 1420), the refrigerator 1 may determine whether the rpm of the transfer motor 230 is greater than reference rpm, in operation 1450.

Ice cubes agglomerated weak may not completely interfere with a rotation of the transfer member 220, however, the ice cubes may cause the transfer member 220 to rotate slowly. For example, if ice cubes stored in the ice bucket 210 agglomerate weak, the ice cubes may interfere with a rotation of the transfer member 220. Also, a load of the transfer motor 230 may increase, and the transfer motor 230 may rotate slowly.

The controller 310 may determine the rpm of the transfer motor 230 based on information representing the rpm of the transfer motor 230, and compare the rpm of the transfer motor 230 to reference rpm, thereby determining a degree of ice agglomeration. Herein, the reference rpm may be rpm that is greater than zero.

If the rpm of the transfer motor 230 is not greater than the reference rpm ("NO" in operation 1450), the refrigerator 1 may continue to perform the ice agglomeration preventing operation, in operation 1460.

The transfer member 220 can rotate although the rotation of the transfer member 220 is interfered. Accordingly, the agglomerated ice cubes can be separated by the rotation of the transfer member 220, and the agglomerated ice cubes can be transferred by the rotation of the transfer member 220. Accordingly, the refrigerator 1 can continue to perform the ice agglomeration preventing operation.

When the transfer member 220 rotates, the weak sticking of the ice cubes may be broken, and accordingly, the ice cubes stored in the ice bucket 210 may be transferred toward the opposite direction from the outlet 211 or toward the outlet 211.

During the ice agglomeration preventing operation, the refrigerator 1 may warn the user of agglomeration of the ice cubes stored in the ice making apparatus 60, in operation 1470.

Although partial sticking of the ice cubes is broken by the rotation of the transfer member 220, the refrigerator 1 may determine that ice agglomeration has occurred, based on the rpm of the transfer motor 230.

Accordingly, in order to cause the user to recognize ice agglomeration, the refrigerator 1 may warn the user of ice agglomeration using various methods.

For example, the refrigerator 1 may warn the user of ice agglomeration through the dispenser display panel 43.

As described above, the screen of the dispenser display panel 43 may include the ice agglomeration warning image 43*e* to warn the user of ice agglomeration.

The controller 310 may control the dispenser display panel 43 to display the ice agglomeration warning image 43*e*.

The user may see the ice agglomeration warning image 43*e* displayed on the dispenser display panel 43 to recognize agglomeration of the ice cubes stored in the ice making apparatus 60.

According to another example, the refrigerator 1 may warn the user of ice agglomeration through the speaker 34.

More specifically, the controller 310 may control the speaker 340 to output a sound message for warning of agglomeration of the ice cubes stored in the ice making apparatus 60. Particularly, when the door 30 opens, the controller 310 may control the speaker 340 to output a sound message for warning of agglomeration of the ice cubes stored in the ice making apparatus 60.

The user may hear the sound message output from the speaker 340 to recognize agglomeration of the ice cubes stored in the ice making apparatus 60.

If the rpm of the transfer motor 230 is greater than the reference rpm ("YES" in operation 1450), the refrigerator 1 may continue to perform the ice agglomeration preventing operation, in operation 1480.

That is, the refrigerator 1 may continue to perform the operation for preventing agglomeration of the ice cubes stored in the ice bucket 210. For example, the controller 310 may rotate the transfer motor 230 in the first rotation direction for the first transfer time period, and then rotate the transfer motor 230 in the second rotation direction for the second transfer time period.

As described above, the refrigerator 1 may determine a degree of agglomeration of the ice cubes stored in the ice bucket 210, based on an output from the transfer motor 230, and request the user to remove the ice cubes stored in the ice making apparatus 60 or warn the user of agglomeration of the ice cubes stored in the ice making apparatus 60, based on a degree of ice agglomeration.

Figure 21:
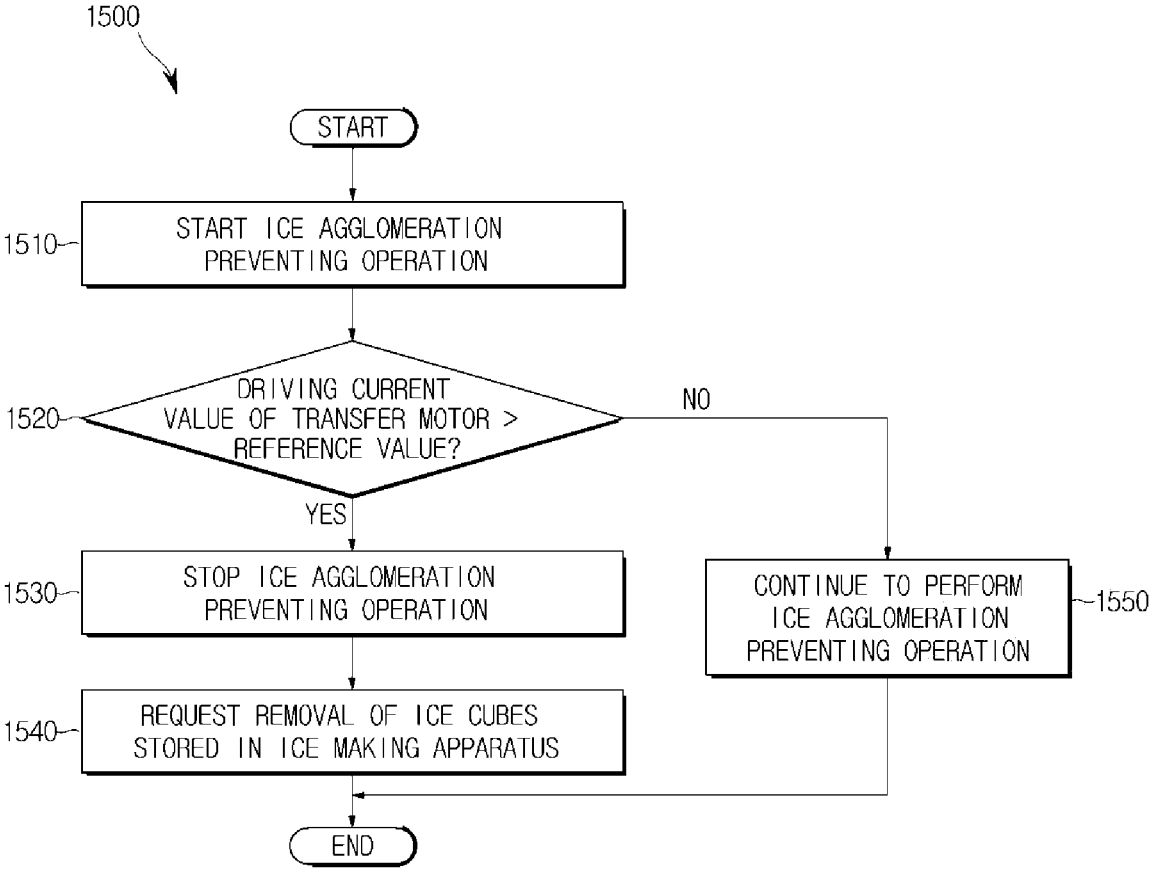
FIG. 21 is a flowchart illustrating another example of an ice agglomeration warning operation of a refrigerator according to an embodiment.

FIG. 21 is a flowchart illustrating another example of an ice agglomeration warning operation of a refrigerator according to an embodiment.

Hereinafter, an ice agglomeration warning operation 1500 of the refrigerator 1 will be described with reference to FIG. 21.

The refrigerator 1 may start an ice agglomeration preventing operation, in operation 1510.

The operation 1510 may be the same as the operation 1410 shown in FIG. 18.

During the ice agglomeration preventing operation, the refrigerator 1 may determine whether a driving current value supplied to the transfer motor 230 is greater than a reference value, in operation 1520.

The transfer motor 230 may rotate in the first rotation direction or in the second rotation direction in response to a control signal from the controller 310. Also, the transfer motor 230 may output information about driving current while rotating.

The controller 310 may determine a driving current value of the transfer motor 230 based on the information about the driving current of the transfer motor 230. Also, the controller 310 may compare the driving current value of the transfer motor 230 to a reference value.

Ice cubes agglomerated hard may interfere with a rotation of the transfer member 220, and due to the agglomerated ice cubes, the transfer member 220 and the transfer motor 230 may not rotate. If the transfer motor 230 does not rotate, a driving current value that is supplied to the transfer motor 230 may increase.

The controller 310 may determine a degree of ice agglomeration based on the result of the comparison between the driving current value of the transfer motor 230 and the reference value. In other words, the controller 310 may determine whether the ice cubes have agglomerated hard. The reference value may be a driving current value that is supplied to the transfer motor 230 when the transfer motor 230 does not rotate.

If the driving current value of the transfer motor 230 is greater than the reference value ("YES" in operation 1520), the refrigerator 1 may stop the ice agglomeration preventing operation, in operation 1530.

If the driving current value of the transfer motor 230 is greater than the reference value, it may be determined that the ice cubes have agglomerated hard. That is, it can be determined that the transfer member 220 cannot rotate due to the ice cubes agglomerated hard.

Accordingly, the controller 310 may stop the ice agglomeration preventing operation.

Thereafter, the refrigerator 1 may request the user to remove the ice cubes stored in the ice making apparatus 60, in operation 1540.

The operation 1540 may be the same as the operation 1440 shown in FIG. 18.

If the driving current value of the transfer motor 230 is not greater than the reference value ("NO" in operation 1520), the refrigerator 1 may continue to perform the ice agglomeration preventing operation, in operation 1550.

That is, the refrigerator 1 may continue to perform the operation for preventing the ice cubes stored in the ice bucket 210 from agglomerating. For example, the controller 310 may rotate the transfer motor 230 in the first rotation direction for the first transfer time period, and then rotate the transfer motor 230 in the second rotation direction for the second transfer time period.

As described above, the refrigerator 1 may determine a degree of agglomeration of the ice cubes stored in the ice bucket 210, based on an output from the transfer motor 230, and request the user to remove the ice cubes stored in the ice making apparatus 60, according to the degree of agglomeration of the ice cubes.

According to an aspect of the present disclosure, there may be provided the refrigerator capable of preventing ice agglomeration.

According to another aspect of the present disclosure, there may be provided the refrigerator capable of warning a user of ice agglomeration.

Exemplary embodiments of the present disclosure have been described above. In the exemplary embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described exemplary embodiments, embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While exemplary embodiments have been described with respect to a limited number of embodiments, those skilled in the art, having the benefit of this disclosure, will appreciate that other embodiments can be devised which do not depart from the scope as disclosed herein. Accordingly, the scope should be limited only by the attached claims.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

an ice storage;

an auger;

a transfer motor coupled to the auger; and a controller configured to:

control the transfer motor to rotate the auger in a first rotation direction for a first transfer time period such that the auger transfers ice cubes stored in the ice storage in an opposite direction from an outlet of the ice storage and a second rotation direction for a second transfer time period such that the auger transfers the ice cubes toward the outlet, where the first transfer time period is longer than or equal to the second transfer time period, where the auger is configured to prevent the ice cubes stored in the ice storage from agglomerating by rotating in the first rotation direction and the second rotation direction, and warn, in response to no rotation of the transfer motor sensed, a user of agglomeration of the ice cubes stored in the ice storage.

2. The refrigerator according to claim 1, wherein the first transfer time period is longer than the second transfer time period.

3. The refrigerator according to claim 1, wherein:

the controller is configured to display, in response to no rotation of the transfer motor sensed, an image message for requesting removal of the ice cubes stored in the ice storage; and the image message is displayed on a display.

4. The refrigerator according to claim 1, wherein:

the controller is configured to output, in response to no rotation of the transfer motor sensed, a sound message for requesting removal of the ice cubes stored in the ice storage; and the sound message is output through a speaker.

5. The refrigerator according to claim 4, wherein:

the controller is configured to output, in response to opening a door of the refrigerator, the sound message for requesting removal of the ice cubes stored in the ice storage; and the sound message is output through the speaker.

6. The refrigerator according to claim 1, wherein the controller is further configured to control, when a time period elapsed after the transfer motor stops is longer than a first reference time period, the transfer motor to rotate the auger in the first rotation direction and the second rotation direction.

7. The refrigerator according to claim 1, wherein the controller is further configured to control, when an operation time period of a cooling apparatus for supplying cool air to the ice storage is longer than a reference time period, the transfer motor to rotate the auger in the first rotation direction and the second rotation direction.

8. The refrigerator according to claim 1, wherein the controller is further configured to control, when a number of times a door of the refrigerator opens is greater than a first reference number of times, the transfer motor to rotate the auger in the first rotation direction and the second rotation direction.

9. The refrigerator according to claim 1, wherein the controller is further configured to control, when a number of times a refrigerant pipe included in an ice maker is defrosted is greater than a second reference number of times, the transfer motor to rotate the auger in the first rotation direction and the second rotation direction.

10. A method of controlling a refrigerator including an ice storage for storing ice cubes, the method comprising:

preventing an ice agglomeration by rotating an auger for discharging the ice cubes in a first rotation direction for a first transfer time period such that the auger transfers the ice cubes in an opposite direction from an outlet of the ice storage and a second rotation direction for a second transfer time period such that the auger transfers the ice cubes toward the outlet, where the first transfer time period is longer than or equal to the second transfer time period; and warning, in response to no rotation of the auger sensed, a user of agglomeration of the ice cubes stored in the ice storage.

11. The method according to claim 10, wherein the first transfer time period is longer than the second transfer time period.

12. The method according to claim 10, wherein the warning of the user of the agglomeration of the ice cubes comprises displaying, in response to no rotation of the auger sensed, an image message for requesting removal of the ice cubes stored in the ice storage.

13. The method according to claim 10, wherein the warning of the user of the agglomeration of the ice cubes comprises outputting, in response to no rotation of the auger sensed, a sound message for requesting removal of the ice cubes stored in the ice storage.

14. The method according to claim 13, wherein the outputting of the sound message comprises outputting, in response to a door of the refrigerator opened, the sound message for requesting removal of the ice cubes stored in the ice storage.

15. The method according to claim 10, wherein the preventing of the ice agglomeration further comprises preventing the ice agglomeration when a time period, which elapsed after the ice agglomeration preventing operation terminates, is longer than a first reference time period.

16. The method according to claim 10, wherein:

the preventing of the ice agglomeration further comprises preventing the ice agglomeration when an operation time period is longer than a reference time period; and the operation time period is an operation time period of a cooling apparatus for supplying cool air to the ice storage after the ice agglomeration preventing operation terminates.

17. The method according to claim 10, wherein the preventing of the ice agglomeration further comprises preventing the ice agglomeration when a number of times a door of the refrigerator opens after the ice agglomeration preventing operation terminates is greater than a first reference number of times.

18. The method according to claim 10, wherein the preventing of the ice agglomeration further comprises preventing the ice agglomeration when a number of times a refrigerant pipe included in an ice maker is defrosted after the ice agglomeration preventing operation terminates is greater than a second reference number of times.

* * * * *